United States Patent [19]

Vorachek et al.

[11] Patent Number: 4,683,704

[45] Date of Patent: Aug. 4, 1987

[54] METHOD OF AND APPARATUS FOR WRAPPING

[75] Inventors: Michael J. Vorachek, Sheboygan Falls; Guy P. Entringer, Sheboygan; Otis E. Meives, Cleveland; Gary L. Lynch, Sheboygan; Anthony J. Lutzke, Elkhart Lake, all of Wis.

[73] Assignee: Pemco, Inc., Sheboygan, Wis.

[21] Appl. No.: 893,456

[22] Filed: Aug. 7, 1986

Related U.S. Application Data

[63] Continuation of Ser. No. 543,085, Oct. 18, 1983, abandoned.

[51] Int. Cl.[4] ..... B65B 11/00; B65B 57/16

[52] U.S. Cl. ..... 53/461; 53/58; 53/77; 53/493

[58] Field of Search ..... 198/341; 53/493

[56] References Cited

U.S. PATENT DOCUMENTS

| | | | |
|---|---|---|---|
| 3,248,844 | 5/1966 | Cross | 53/493 X |
| 3,613,858 | 10/1971 | Cox | 198/341 |
| 4,135,346 | 1/1979 | Rebsamen | 53/493 |
| 4,394,896 | 7/1983 | McComas | 198/341 |
| 4,514,963 | 5/1985 | Bruno | 53/493 |

FOREIGN PATENT DOCUMENTS

| | | | |
|---|---|---|---|
| 2093425 | 9/1982 | United Kingdom | 198/341 |
| 302885 | 4/1971 | U.S.S.R. | 53/493 |

*Primary Examiner*—John Sipos

*Attorney, Agent, or Firm*—Peter K. Kontler

[57] ABSTRACT

Method of and apparatus for wrapping articles, in particular for wrapping reams of paper in a sheet of wrapping material such as paper or the like. The method comprises coupling the wrapping apparatus to the sheeter which produces the reams so as to automatically, continuously synchronize their operation, automatically adjusting the machine position of the wrapping apparatus relative to the position of the sheeter to ensure synchronization of the wrapping apparatus with the sheeter, monitoring the reams randomly received by the wrapping apparatus from the sheeter and delaying select reams so as to effect desired spacing therebetween, feeding delayed reams to the wrapping means of the wrapping apparatus at predetermined points during the cycle of the wrapping means, coupling the drive of the wrapping apparatus to the drives for the web positioning and wrapper sheet transfer means for precisely advancing the web and wrapper sheets to the cutting and draping positions, respectively, in a gradually accelerating, constant, gradually decelerating manner keyed to the wrapping means' cycle.

14 Claims, 34 Drawing Figures

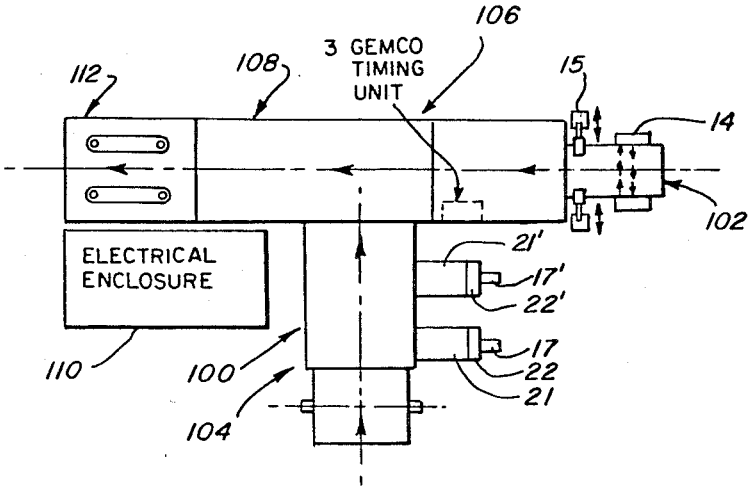
FIG. 3
FIG. 4
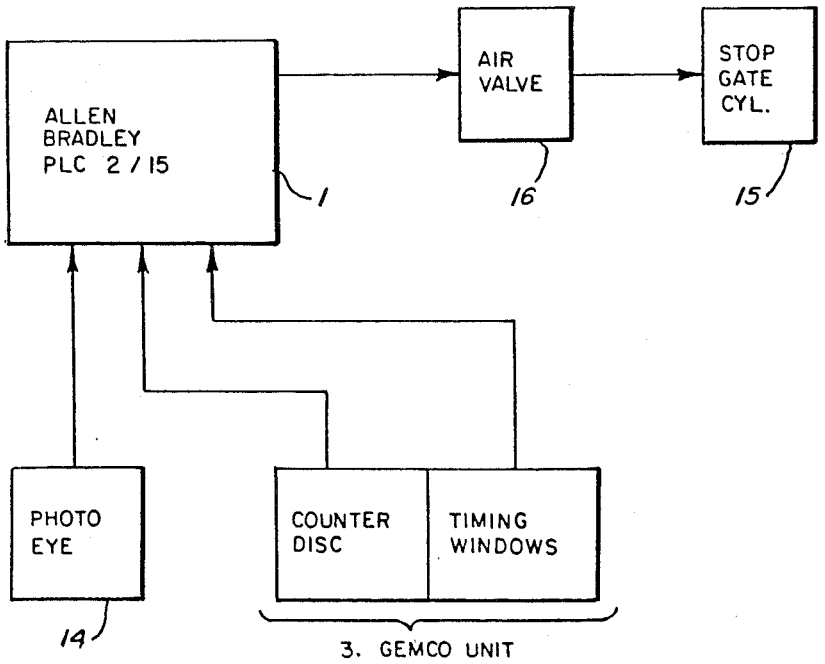

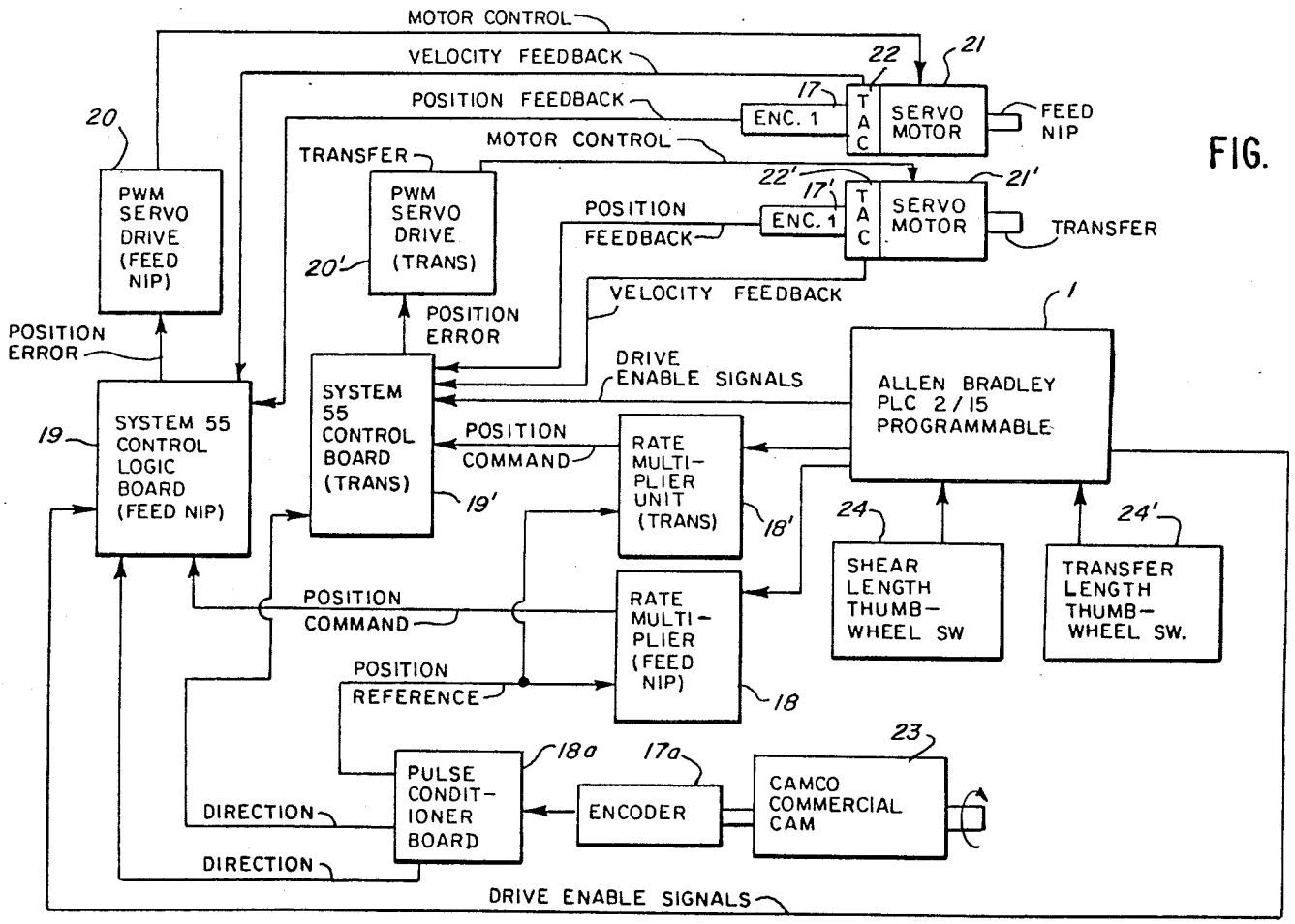
FIG. 7
FEED NIP
TRANSFER
SERVO MOTOR
SERVO MOTOR
T A C
T A C
ENC. 1
ENC. 1
ALLEN BRADLEY PLC 2/15 PROGRAMMABLE
TRANSFER LENGTH THUMB-WHEEL SW.
SHEAR LENGTH THUMB-WHEEL SW
CAMCO COMMERCIAL CAM
ENCODER
PULSE CONDIT-IONER BOARD
RATE MULTI-PLIER UNIT (TRANS)
RATE MULTI-PLIER (FEED NIP)
SYSTEM 55 CONTROL BOARD (TRANS)
SYSTEM 55 CONTROL LOGIC BOARD (FEED NIP)
PWM SERVO DRIVE (TRANS)
PWM SERVO DRIVE (FEED NIP)
MOTOR CONTROL
VELOCITY FEEDBACK
POSITION FEEDBACK
MOTOR CONTROL
POSITION FEEDBACK
VELOCITY FEEDBACK
DRIVE ENABLE SIGNALS
POSITION COMMAND
POSITION ERROR
TRANSFER
POSITION ERROR
POSITION COMMAND
POSITION REFERENCE
DIRECTION
DIRECTION
DRIVE ENABLE SIGNALS
1
17
17'
17a
18
18'
18a
19
19'
20
20'
21
21'
22
22'
23
24
24'

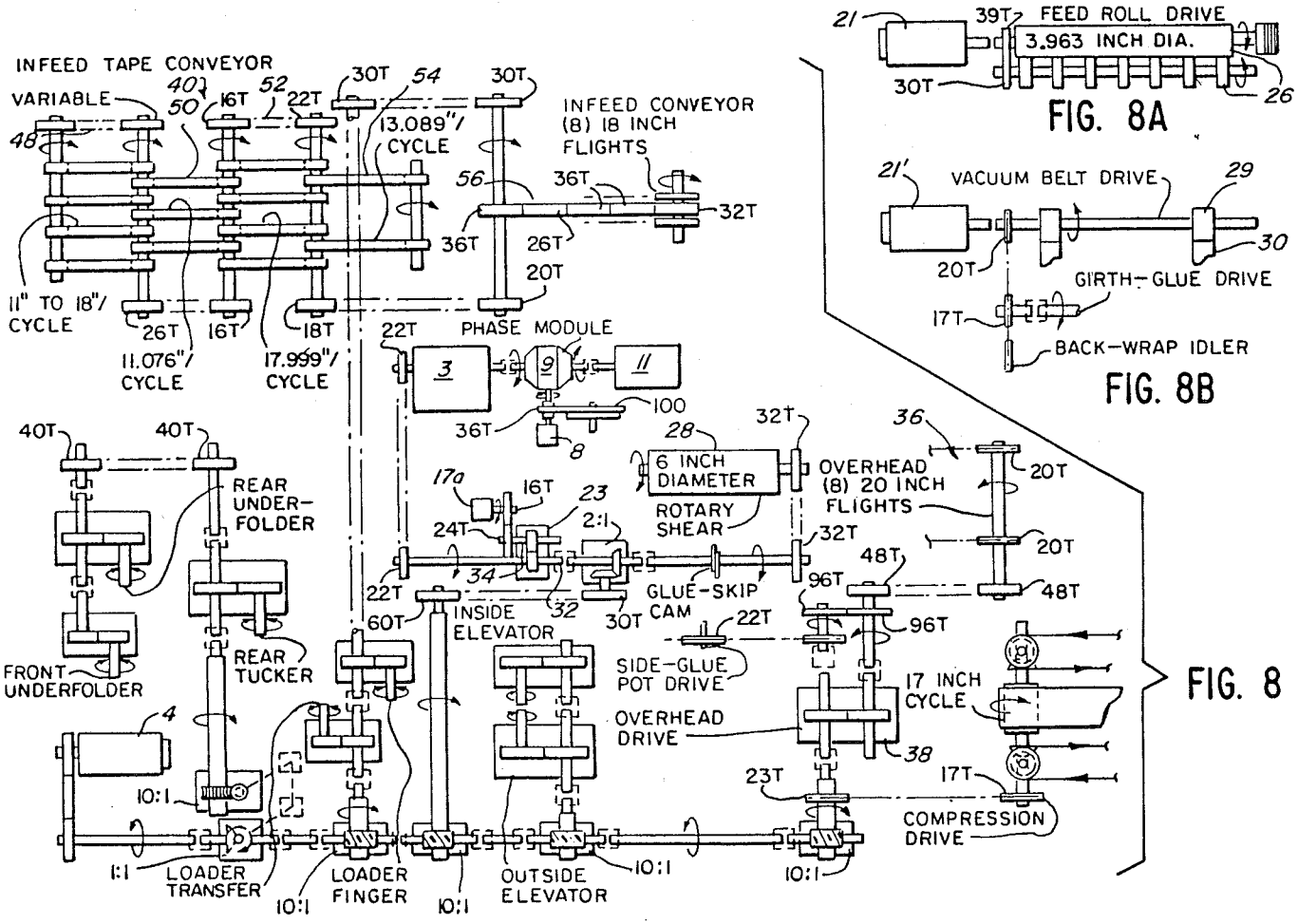
FIG. 8A
FIG. 8B
FIG. 8
FEED ROLL DRIVE
3.963 INCH DIA.
VACUUM BELT DRIVE
GIRTH-GLUE DRIVE
BACK-WRAP IDLER
OVERHEAD (8) 20 INCH FLIGHTS
6 INCH DIAMETER
ROTARY SHEAR
GLUE-SKIP CAM
SIDE-GLUE POT DRIVE
OVERHEAD DRIVE
17 INCH CYCLE
COMPRESSION DRIVE
INFEED CONVEYOR (8) 18 INCH FLIGHTS
PHASE MODULE
INSIDE ELEVATOR
OUTSIDE ELEVATOR
LOADER FINGER
LOADER TRANSFER
REAR UNDER-FOLDER
REAR TUCKER
FRONT-UNDERFOLDER
INFEED TAPE CONVEYOR
VARIABLE
13.089"/ CYCLE
17.999"/ CYCLE
11.076"/ CYCLE
11" TO 18"/ CYCLE

METHOD OF AND APPARATUS FOR WRAPPING

This application is a continuation, of application Ser. No. 543,085, filed Oct. 18, 1983 abandoned.

BACKGROUND OF THE INVENTION

This invention relates to a method of and apparatus for wrapping articles, and more particularly to a method of and apparatus for wrapping units such as reams of paper each in a wrapper constituted by a sheet of wrapping material such as paper or other suitable wrapping material. While reference herein for simplicity sake often is made to "reams", it is to be understood that the method and apparatus is operable for wrapping other units and that such reference does not limit the nature or scope hereof. It will be understood that a ream generally comprises a stack of five hundred sheets of paper, the sheets being $8\frac{1}{2}''$ by $11''$ or $8\frac{1}{2}''$ by $14''$ sheets, for example. Such reams are presently produced in vast quantities by means of an apparatus called a "sheeter", which cuts paper into sheets of the desired size (e.g., $8\frac{1}{2}''$ by $11''$) and stacks up the sheets in reams of five hundred sheets.

The invention is generally in the same field as the methods and apparatus disclosed in U.S. Pat. No. 4,029,194 issued June 14, 1977, entitled Automatic Indexing and Transferring Apparatus, U.S. Pat. No. 4,073,375 issued Feb. 14, 1978, entitled Method of and Apparatus for Feeding Randomly Received Items, U.S. Pat. No. 4,193,491 issued Mar. 18, 1980, entitled Apparatus for Feeding Stacks of Sheets, Such as Reams of Paper, U.S. Pat. No. 3,458,026 issued July 29, 1969, entitled Article Spacer, U.S. Pat. No. 4,203,694 issued May 20, 1980, entitled Squaring Reams of Paper for Wrapping, U.S. Pat. No. 3,533,496 issued Oct. 13, 1970, entitled Method for Guiding while Longitudinally Conveying a Ream of Single Sheets of Paper, U.S. Pat. No. 3,861,120 issued Jan. 21, 1975 and U.S. Pat. No. 4,279,116 issued July 21, 1981, each entitled Wrapping Apparatus, U.S. Pat. No. 3,213,591 issued Oct. 26, 1965, entitled Packaging and Wrapping Machine, U.S. Pat. No. 4,011,155 issued Mar. 8, 1977, entitled Wrapped Package Inspection and Rejection Apparatus, and in the assignee's printed literature for its Model 66 wrapping apparatus (designed to operate at speeds between 20 and 41 reams per minute) and its Model 35 and 36 wrapping apparatus (designed to operate at speeds of up to 60 and up to 80 reams per minute, respectively). The disclosure of the assignee's literature as well as the disclosure of the cited U.S. patents is hereby expressly incorporated herein by reference.

Wrapping such reams of paper and especially wrapping them at relatively high production rates presents special problems. For one thing, it is difficult to maintain the integrity of the reams (i.e., maintaining the reams with all the sheets in register).

Also, problems are encountered because the reams are delivered to the wrapping apparatus with slight spacing irregularities between successive reams (in other words, the reams are randomly received, i.e., they are not exactly equally spaced from one another), and the rate at which the reams are delivered is not necessarily a fixed ratio relative to the speed at which the wrapping apparatus is operated (i.e., the sheeter, the ream delivery system and the wrapping apparatus may not share a common drive). The spacing variations between the reams and the differences between the delivery rate of the reams and cycling rate of the apparatus causes the reams to be delivered periodically in and out of phase with the cycle of the wrapping apparatus. This can result in jamming of the wrapping apparatus.

Problems are further encountered in accurately operating the web positioning, and wrapper sheet transferring portions of the wrapping apparatus which relate to supply of wrapper blanks for wrapping around the reams. These aspects of the wrapping operation are particularly important because the wrapping sheet is often imprinted. Unless these aspects are properly carried out, the web may be cut through the imprint or the wrapper sheet may be wrapped around the ream with the imprint improperly positioned on the ream. Prior art methods and apparatus for accomplishing web positioning and wrapper sheet transfer have utilized electronic controls (e.g., PC boards) for controlling the drives for the web positioning and wrapper sheet transferring mechanisms. Such electronic controls have been able to effect positioning of the web and wrapper sheets, but with ramped acceleration and deceleration of the web and wrapper sheets in a sort of glitch and hunt motion. The time constraints under which the web must be paid out, positioned and cut and under which the cut wrapping sheet must be subsequently transferred into position for draping over the ream require speeds of operation that can thus involve jerky starts and stops of the apparatus using such prior art methods and apparatus. Damage to the web and wrapper sheet and undesirable excessive wear of the wrapping apparatus components can result. Moreover, such prior art solutions are expensive.

Still further problems are encountered in operating the cutting mechanism. Prior art reciprocating guillotine cutting blade mechanisms create excessive noise and prior art rotary cutting mechanisms disposed above the plane of the web are difficult to adjust and to replace and they deleteriously interfere with the ability to position the subsequent wrapper sheet transfer mechanism (in the form of a vacuum belt to the underside of which the wrapper sheet is held by suction) in a manner so as to support the cut wrapper sheet against curling along its cut edge.

Finally, problems are encountered in handling of the reams during outfeed (which commences while the reams are in the process of being wrapped by the wrapping means), so as to insure that the reams are not damaged. High speed motion must be imparted to each ream as it is being acted upon by the wrapping means so as to effect its removal from the wrapping in an extremely expeditious manner to permit wrapping of the succeeding web. And yet, such high speed motion must be imparted to the stationary ream without damaging the ream or knocking the ream out of alignment. A greater variation in the speeds and a more gradual acceleration of the overhead discharge conveyor which effects removal or outfeed of each ream being acted upon by the wrapping means than has been possible with the prior art is required.

The aforementioned problems become particularly acute when the wrapping apparatus is operated at speeds in excess of 100 reams per minute. The prior methods and apparatus have worked acceptably at lower speeds of 60–80 reams per minute, but they have proved unsatisfactory and unreliable at higher operating speeds, i.e., at speeds in excess of 100 reams per minute. They either cannot operated at such speeds or cannot sustain such speeds, i.e., they have a very short service life at such speeds.

OBJECTS AND SUMMARY OF THE INVENTION

The present method and apparatus is directed to overcoming the aforementioned problems in such a way as to permit routine operation at speeds in excess of 100 reams per minute. The present method and apparatus are not merely an improvement over prior art but rather represent a "second (or third) generation" wrapping method and apparatus which overcome the aforementioned problems in novel and unique ways so as to permit operation of the wrapping apparatus at what, for industry conceptions, are significantly increased, heretofore unattainable, consistent operating levels.

Among the several objects of the invention may be noted the provision of an improved method of and apparatus especially for wrapping reams of paper, although quite suitable for wrapping other units to be wrapped, at a relatively high production rate without losing the integrity of the ream.

Another object of this invention is the provision of a novel and unique method of and apparatus for coupling the sheeter and wrapping apparatus so as to automatically, continuously synchronize the operation of the two.

A further object of this invention is the provision of novel and unique method of and apparatus for adjusting the wrapping apparatus to keep it in phase with the sheeter.

An additional object of this invention is the provision of novel and unique method of and apparatus for adjusting the machine position of the wrapping apparatus relative to the position of the reams discharged by the sheeter, where the position of the discharged reams is not always the same relative to the machine position of the sheeter.

A still further object of this invention is the provision of novel and unique wrapping apparatus which can accommodate variances in spacing between successive reams to be wrapped.

A yet further object of this invention is the provision of novel and unique method of and apparatus for effecting desired spacing between reams delivered to wrapping means of the wrapping apparatus so that randomly received reams can be routinely handled without requiring operation of the wrapping apparatus and sheeter at different speeds.

Another object of this invention is the provision of novel and unique method of and apparatus for feeding or pacing reams to be wrapped to continuously operable wrapping means of the wrapping apparatus which cycles at a steady rate.

An additional object of this invention is the provision of novel and unique method of and apparatus for wrapping including a method of and means for conveying means to wrapping means of the wrapping apparatus and a method of and means for delaying conveyance of the reams to the wrapping means without damage to the reams.

An additional object of this invention is the provision of novel and unique method and apparatus for effecting precise control of wrapper web positioning and wrapper sheet transferring means keyed to cycling of the wrapping apparatus.

Another object of this invention is the provision of novel and unique method and apparatus for effecting coupling of the drives for the wrapper web positioning and wrapper sheet transfer means to the drive of the wrapping apparatus so as to avoid sudden jerky starts and stops and possible damage to the web or wrapper sheets.

Another object of this invention is the provision of novel and unique wrapper web cutting means which permits greater support of the wrapper sheet which is cut off so as to avoid curling.

An additional object of this invention is the provision of novel and unique wrapper web cutting means which facilitates easy replacement and adjustment of the cutting means.

A further object of this invention is the provision of novel and unique method and apparatus for expeditiously discharging wrapped reams without damage.

A still further object of this invention is the provision of wrapping apparatus which is of relatively simple construction, which is reliable in operation, and which has a long service life.

Briefly, the method of this invention comprises feeding reams one after another to a wrapping apparatus which cycles continuously at a steady rate with a ream being receivable by wrapping means of the wrapping apparatus only during a select portion of each cycle of the wrapping means. The reams to be fed to the wrapping apparatus are randomly delivered one at a time at an average rate from a sheeter. The method comprises electronically coupling the sheeter and wrapping apparatus so that they operate in synchronism at the same speeds. The reams coming from the sheeter are monitored and the operation of the wrapping apparatus is modified to align the cycle phases of the sheeter and wrapping apparatus. The reams are fed in a straight line one at a time to a holding or delaying station where a ream may dwell for an interval. Each ream which has been delivered to the holding station is fed further forward in a continuation of the straight line motion in time for delivery to the wrapping means of the wrapping apparatus during the select portion of the cycle of the wrapping means when it is positioned to receive and wrap a ream of sheets of paper. The feeding of a randomly received ream to the holding station occurs at a relatively slow speed while delivery through and away from the holding station occurs at a higher speed. The feeding forward of a ream which has been delivered to the holding station too late for delivery to the wrapping means during the portion of a cycle thereof is deferred until a next successive cycle of the wrapping means. A ream delayed at the holding station is quickly accelerated to the higher speed and thus moves ahead of any following ream which may have abutted against it while it was delayed inasmuch as the following ream is still travelling at the slower speed. The holding station operates in phased relation to delivery of a delayed ream through and away from the holding station so as to limit possible contact of components of the holding station with the delayed ream, which contact should be deleterious to the ream's integrity.

The method of this invention further comprises improved positioning of the wrapper web, cutting of the wrapper web into wrapper sheets and transferring of the wrapper sheets. The web positioning and wrapper sheet transfer means are coupled to the main drive for the wrapping apparatus so that, dependent upon the length of the wrapper sheet needed, the wrapper web will move a certain amount prior to cutting and the wrapper sheets will move some other amount (possibly even the same amount as the wrapper web moved) after cutting in a gradually accelerating, constant, gradually decelerating motion keyed to the wrapping apparatus' cycle, thus avoiding sudden jerky start and stop motions. The cutting means is disposed below the wrapper web such that a greater portion of the wrapper sheet which is cut off can be supported by the transfer means against curling.

Finally, the method of the invention comprises controlled removal of reams being acted upon the wrapping means of the wrapping apparatus from the wrapping means through to ultimate discharge from the wrapping apparatus. Reams in the process of being wrapped by the wrapping means are engaged by overhead conveyor means traveling at a significantly reduced rate of speed. After initial engagement, the overhead conveyor means progressively accelerates to a high speed so as to expeditiously remove the reams from the wrapping means without jarring the ream or causing misalignment of the ream. Before engaging a succeeding ream, the overhead conveyor means is decelerated to the reduced speed so that upon initial engagement of the succeeding ream no bouncing or jarring of the succeeding ream occurs.

Wrapping apparatus of this invention comprises conveying apparatus for feeding reams one after the other to wrapping means which cycles continuously at a steady rate with a ream being receivable by the wrapping means only during a select portion of each cycle thereof. The reams to be fed to the wrapping means are randomly delivered to the conveying apparatus one at a time at an average rate from a sheeter. The wrapping apparatus further comprises holding means for delaying reams fed by the conveying apparatus to ensure that they are delivered to the wrapping means during the select portion of its cycle when it is able to receive and handle same. The wrapping apparatus further comprises an electronic line shaft for coupling the sheeter and the wrapping apparatus for synchronizing their operation and a phase adjust loop incorporated into the electronic line shaft for adjusting the phase relationship between the ream position on the sheeter and the wrapping apparatus.

The wrapping apparatus of the invention still further comprises positioning means for advancing a web of paper to be cut into wrapper sheets to a predetermined position where it is cut and transfer means for transferring each wrapper sheet to an overlying position with respect to the ream about which it is to be draped, wherein the positioning and transfer means comprise independent DC servo motor which is connected to a cam unit driven by the main drive of the wrappiing apparatus and whose velocity is determined by the velocity curve of the cam unit as if the motor and cam unit where mechanically coupled. Means is provided for readily varying the relationship between the velocities of the motor of the positioning means and transfer means and the cam unit so that different size wrapper sheets can easily be produced as needed. The cutting means is in the form of rotary cutting means mounted beneath the web which acts against a counter knife mounted above the web, thus permitting the transfer means which is disposed above the web to more fully support the position of the web which is cut off as a wrapper sheet and thereby avoid curling of the cut edge of the wrapper sheet. Such mounting of the counter knife above the rotary cutter knife also provides for easy access for repair or replacement and for easy adjustment.

Finally, the wrapping apparatus of the invention comprises overhead discharge conveyor means which operates at varying rates of speed under the control of a conjugate cam. The overhead conveyor means initially engages reams being processed by the wrapper means at a reduced speed to avoid jarring or bounce of the reams and to avoid damage to the reams. The overhead conveyor means then progressively accelerates to expedite removal of reams from the wrapping means. Thereafter, the speed of the overhead conveyor means remains constant until the overhead conveyor means is about to engage the next succeeding ream, at which point the speed of the overhead conveyor means is rapidly decelerated such that the overhead conveyor means is again moving at its original slower speed, whereupon it again engages a ream, in this case the next succeeding ream.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drrawing.

BRIEF DESCRIPTION OF THE DRAWINGS

FIG. 3 is a plan view showing the location of components of the holding station or ream stop gate system of the invention;

FIG. 4 is a schematic showing the communication between various components of the holding station or ream stop gate system of the invention;

FIG. 7 is a schematic showing the communication between various components of the web positioning and wrapper sheet transfer system of the invention;

FIG. 8 is a drive schematic showing the mechanical coupling of various components of the invention;

FIG. 8A is a drive schematic showing the mechanical coupling of various components of the web positioning system of the invention;

FIG. 8B is a drive schematic showing the mechanical coupling of various components of the wrapper sheet transfer system of the invention;

DESCRIPTION OF THE PREFERRED EMBODIMENTS

Figure 1:
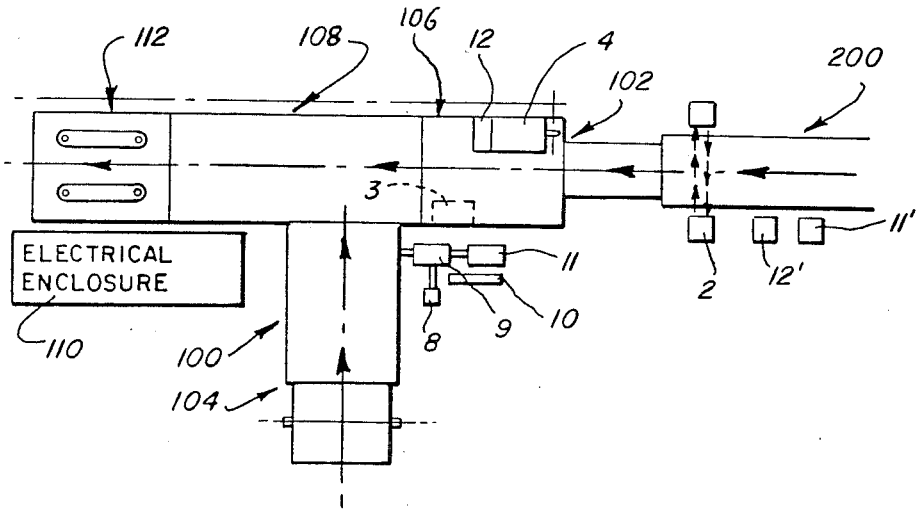
FIG. 1 is a plan view showing the location of components of the resolver phase adjustment system of the invention.

FIG. 1 shows a wrapping apparatus or ream wrapper 100 and a sheeter 200 and various components of a resolver phase adjustment system for regulating the operation of the wrapping apparatus 100 so as to synchronize it with operation of the sheeter 200. The resolver phase adjustment system comprises an electrical line shaft between the sheeter 200 and wrapping apparatus 100 having a phase adjust loop. When the electrical line shaft is enabled, the wrapping apparatus 100 operates as if it was mechanically coupled to the sheeter 200 and follows both the speed and position of the sheeter 200. The purpose of the phase adjust loop is to adjust the phase of the wrapping apparatus 100 to align it with the position of the reaskm on the discharge conveyor of the sheeter 200.

The wrapping apparatus 100 includes an infeed section 102, a shearing assembly 104, a wrapping section 106, an overhead discharge section 108, an electical enclosure 110 and a compression assembly 112. Within the electrical enclosure 110 are the following components of the resolver phase adjustment system (shown schematically in FIG. 2): a programmable controller 1, a servo pulse width modulated drive 5, a transducer interface 6 and an electronic relay 7. Mounted on the wrapping apparatus 100 are the following components of the resolver phase adjustment system: a rotating cam limit switch and pulse generating disc 3, a DC servo motor 4 which is the main drive for the wrapping apparatus 100, a reversible stepping motor 8, a dynamic differential input/output phase adjuster drive 9, a counter proximity switch 10, a slave resolver or feed back assembly 11, and a tachometer 12. Mounted on the sheeter 200 are the following components of the resolver phase adjustment system: a master feed back assembly or resolver 11', a master tach 12' and a photoelectric product detection eye 2. The slave resolver 11 is mechanically coupled to the wrapping apparatus 100. The resolver 11' and tach 12' are mechanically coupled to the sheeter 200 and essentially provide a position and velocity reference. Signals from the master and slave resolvers 11' and 11, respectively, are summed into the transducer interface board 6. The transducer interface board 6 outputs an analog signal proportional to the position error of the two resolvers (11' and 11). The position error signal along with the speed reference command from the tach generator 12' coupled to the sheeter 200 provide the reference command for the pulse width modulated (P.W.M.) drive 5. The P.W.M. drive 5 controls the velocity of the motor 4. The tach 12 that is inherent to the motor 4 provides the velocity feedback signal.

Figure 2:
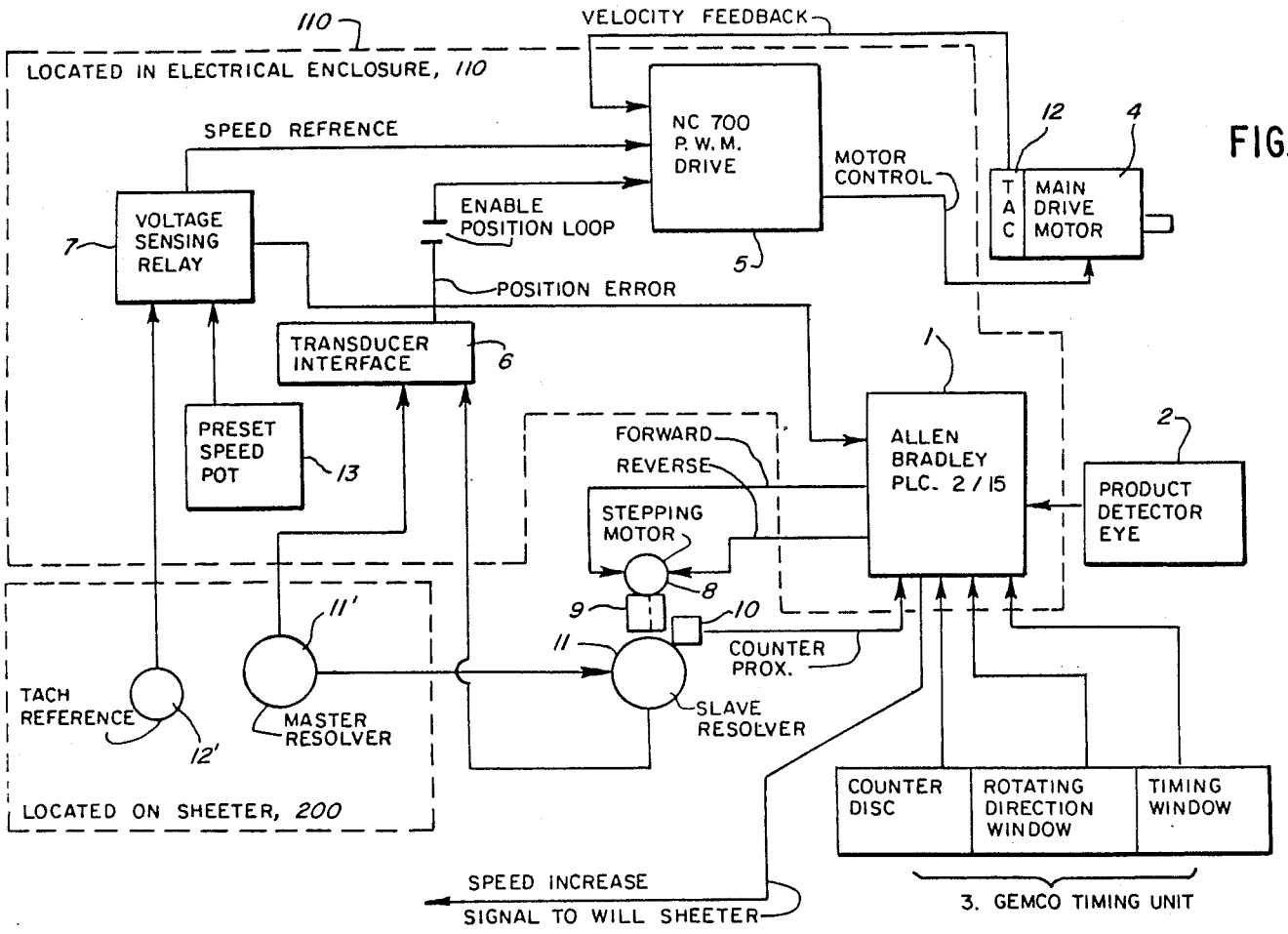
FIG. 2 is a schematic showing the communication between various components of the resolver phase adjustment system of the invention.

The communication of the various components of the resolver phase adjustment system is shown in FIG. 2. Such communication and the nature of the resolver phase adjustment system itself are best understood by considering the operation of the resolver phase adjustment system. Initially, when the operator presses the line drive set push button to begin operation and the speed of the sheeter 200 is below 40 reams per minute, the wrapping apparatus 100 will run at a preset speed. The drive motor 4 for the wrapping apparatus at this time will just be speed regulated and the electrical line shaft between the sheeter and the wrapping apparatus will not be enabled. When the sheeter reaches a speed of 40 reams per minute, which is detected by the amplitude of the tach 12' that is located on the sheeter 200, the voltage sensitive relay 7 is energized. This enables the electrical line shaft, switching the speed reference command from the preset speed pot 13 to the tach reference 12' located on the sheeter 200, and opens up a contact that is interconnected to the sheeter, so that the speed of the sheeter cannot increase. At this point the phase adjusting loop is also enabled. When the leading edge of the first ream blocks the product detector eye 2, the programmable controller 1 senses whether to advance the position of the wrapping apparatus by the position of the rotation direction cam switch 3. The wrapping apparatus always advances when initial synchronization occurs to ensure that a back-to-back ream condition will not occur in the holding station. In addition, at the time the leading edge of the first ream blocks the ream detector eye 2, the programmable controller 1 begins to count pulses from the pulse generating disc 3 in order to determine how far out of the timing window the ream is. A pulse is produced every 20 degrees of machine rotation. After the programmable controller 1 has counted how many pulses the ream is out of the window, it energizes the stepping motor 8 in either the forward or reverse direction to advance or retard the slave resolver 11 position. The stepping motor 8 is mechanically coupled to the dynamic differential input-/output phase adjustor 9. Through such coupling the relative shaft position relationship between the resolver 11' on the sheeter and the resolver 11 on the wrapping apparatus is changed. When the stepping motor 8 is energized in either the forward or reverse direction, the counter proximity switch 10 located on the shaft of the stepping motor 8 produces a count proportional to the number of revolutions the stepping motor shaft travels, such that the stepping motor will remain energized until the count that was established by the pulse generating disc 3 reaches 0. It will remain energized until a count representative of one half the timing window area has also expired. The resultant position of the resolver shaft will have changed, which will send the phase correction error signal through the transducer interface 6 and speed up or slow down the motor 4 to correct the phase error. As additional reams are detected by the product detector eye 2, the phase adjustment system continues to advance or retard the position of the wrapping apparatus with respect to the position of the ream. When the ream detector eye 2 has seen a quantity of three reams in the timing window (the timing window being a cam located on the timing unit 3), the programmable controller 1 will energize a contact that will give the sheeter the ability to increase its speed.

The following commercially available products sold under the indicated company/product names may be used in the resolver phase adjustment system according to FIGS. 1 and 2 of this invention. The programmable controller 1 can be an Allen Bradley Mini PLC 2/15 Programmable Controller. The photoelectric eye 2 can be a Banner Electric Eye Consisting of Emitter ET-1 and Receiver RT-3. The timing unit 3 can be a Gemco #1983-12-08-D-L1 Rotating Cam Limit Switch and S-580-B Pulse Generating Disc. The DC main drive motor 4 can be an Inland DC Servo Motor Inland #TT4503-1000-B. The servo pulse width modulated drive 5 can be an A2274 NC740 Pulse Width Modulated Drive. The transducer interface board 6 can be a Systrol #A0902 Transducer Interface. The voltage sensing relay 7 can be a Systrol #A0907 Electronic Relay 5 Amp. The reversible electric stepping motor 8 can be a Superior #M092-FD08 stepping motor. The dynamic differential input/output phase adjustor drive 9 can be a Candy Dynamic Differential #DD-IA Input/Output Phase Adjuster Drive. The proximity switch 10 can be a Turck #B15-G18-AN7 NPN Output Proximity Switch. The resolvers or feed back assemblies 11 and 11' can each be a Systrol #1127-0000-MOD-705 Feed Back Assembly. The tach generators 12 and 12' can each be a Wertronic #601A100-1 Flange Mount 100 VDC 5 PY Tach. Generator. Finally, the preset speed pot 13 can be an Allen Bradley 2-¼ Watt 10K Pot.

FIG. 3 shows components of a holding station or ream stop gate system of the wrapping apparatus 100. The holding station or ream stop gate system is a part of the infeed section 102 of the wrapping apparatus 100. The components of the holding station or ream stop gate system operate in conjunction with other components of the infeed section 102 shown in FIGS. 13A, 13B, 14A, 14B, 15A, 15B, 16A and 16B, to effect desired spacing between reams delivered by the infeed section 102 to the wrapping section 106 of the wrapping apparatus 100 and to ensure that the reams delivered to the wrapping section 106 are delivered in phase with operation of the wrapping section 106 such that they can be routinely handled by the wrapping section when it is operating at a steady rate.

The holding station or ream stop gate system comprises a photoelectric eye 14 for monitoring reams delivered to the infeed section 102 of the wrapping apparatus 100, stop gates 15 in the nature of air cylinders with shock pads driven by air valves 16 provided downstream of the photoelectric eye 14 in order to impede flow of reams under certain undesirable conditions and programmable controller 1 and timing unit 3.

The communication of the various components of the holding station or ream stop gate system is shown in FIG. 4. Such communication and the nature of the holding station or ream stop gate system itself are best understood by considering the operation of the holding station or ream stop gate system. When a ream is detected by the photoelectric eye 14, the stop gates 15 will close if the ream is out of a predetermined timing window set by timing unit 3. This will stop the ream from travelling further until such time as the infeed timing window on the timing unit 3 is detected. Such detection will energize the air valve solenoid 16 and open the gates 15. The gates will remain open until another ream has been detected outside of the timing window. If two reams are discharged into the infeed section 102 of the wrapping apparatus 100 next to each other with no gap separating them, the conveying means of the infeed section shown in FIG. 13A et. seq. will accelerate the first ream to a higher rate of speed than the speed at which the following ream is moving, thus separating the first ream from the following ream and creating a gap therebetween. When the photoelectric eye 14 detects the trailing edge of the first ream, it will start to count pulses from the counter disc of the timing unit 3. One pulse is generated every 20 degrees of the cycle of the wrapping apparatus. The gap created between the two reams will not be enough to have placed them both in phase, i.e., if the first falls in the timing window the second will follow too soon afterwards to fall in the succeeding window. Therefore, the photoelectric eye will sense that the second or following ream is not within the window and will send a signal to close the gates. The gates will not close immediately, however, but rather the gates will only close after the count has equalled two counts. This gives adequate time for the first ream to clear the gates before they again close. The second ream will remain held by the stop gates until the infeed timing window is again detected. At this time, the stop gates will again open. If, rather than two reams being discharged into the infeed section 102 in abutting relation, abutting between two previously spaced reams occurs because the first ream is delayed by the holding station or ream stop gate system when it is out of phase with the window of the wrapping section 106, then once the gates 15 open to release the first ream, the system will operate in the aforementioned manner as if the reams had been delivered to the infeed section 102 in abutment.

The following commercially available products sold under the indicated company/product names may be used in the holding station or ream stop gate system according to FIGS. 3 and 4 of this invention. The photoelectric eye 14 can be a Banner emitter, receiver electric eye, emitter ET-1, receiver RT-3. The air cylinder with shock pads 15 can be a Tom Thumb #AUT-1-$\frac{1}{8}$-$\frac{1}{2}$-B air cylinder with shock pads. The air valve can be a MAC #224B-121C air valve.

Figure 5:
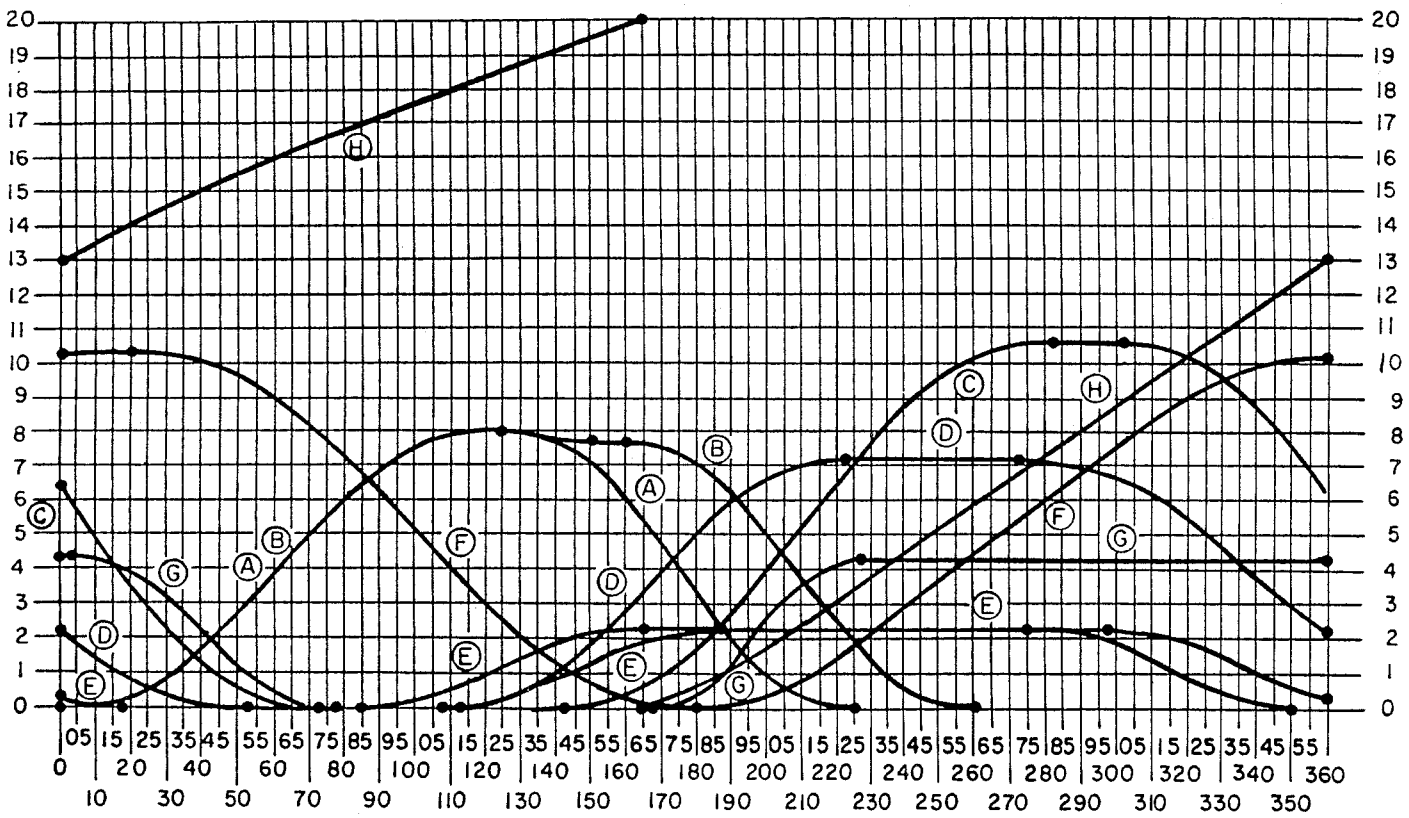
FIG. 5 is a timing graph for various components of the invention.

FIG. 5 is a timing graph for various components of the wrapping apparatus 100. The wrapping section 106 of the wrapping apparatus 100 comprises an outside elevator, an inside elevator, a rear tucker, a rear underfolder, a front underfolder, a loader finger advance and a loader finger raise, seen in FIGS. 9, 10, 22, 23 and 24. The seven curves designated with letters A-G inclusive reflect the extent of movement of the aforementioned seven elements of the wrapping section at various points during the machine cycle from 0 to 360 degrees. The overhead discharge section 108 of the wrapping apparatus 100 comprises overhead conveyor means which acts to remove reams from the wrapping section, under the control of a novel and improved camming means. The curve designated with the letter H reflects the extent of movement of the overhead conveyor means. Specifically, the outside elevator (curve A) commences upward movement at 0 degrees; it reaches its fully raised position at 125 degrees; it reaches its fully lowered (or original position) at 225 degrees; and it dwells from 225 degrees to 0 degrees. The inside elevator (curve B) also commences upward movement at 0 degrees and reaches its fully raised position at 125 degrees. However, the inside elevator begins to lower at 150 degrees and reaches a slightly lowered dwell position at 150 degrees. The inside elevator dwells at the slightly lowered position from 150 degrees to 160 degrees; thereafter downward movement of the inside elevator again commences and the inside elevator finally reaches its fully lowered position at 260 degrees and dwells in such position from 260 degrees to 0 degrees. The rear tucker (curve C) commences movement at 142 degrees; it completes its outward movement at 282 degrees; it dwells from 282 degrees to 302 degrees; then retracts to its fully retracted position at 72 degrees where it again dwells from 72 degrees to 142 degrees. The rear underfolder (curve D) commences movement at 113 degrees; it completes its outer movement at 223 degrees; it dwells from 223 degrees to 273 degrees, at which point it starts its retraction stroke; it is fully retracted at 53 degrees, and it dwells from 53 degrees to 113 degrees. The front underfolder (curve E) starts out at 85 degrees for an 8 inch ream/108 degrees for a 9 inch ream; completes its outer movement at 165 degrees/188 degrees; dwells from 165 to 275 degrees/188 to 298 degrees; is fully retracted at 355 degrees/18 degrees; and again dwells from 355 to 85 degrees/18 to 108 degrees. The loader finger advance (curve F) commences at 180 degrees; completes its outer movement at 360 degrees; dwells from 360 to 20 degrees; and is fully retracted at 180 degrees. The loader finger raise (curve G) starts up at 168 degrees; completes its upward movement at 228 degrees; dwells from 228 degrees to 3 degrees; is fully lowered down at 78 degrees; and dwells from 78 to 168 degrees. The overhead discharge conveyor is continuously in motion, i.e., it cycles between a slow speed at 165 degrees when it picks up reams and a high speed, but never stops movement.

Figure 6:
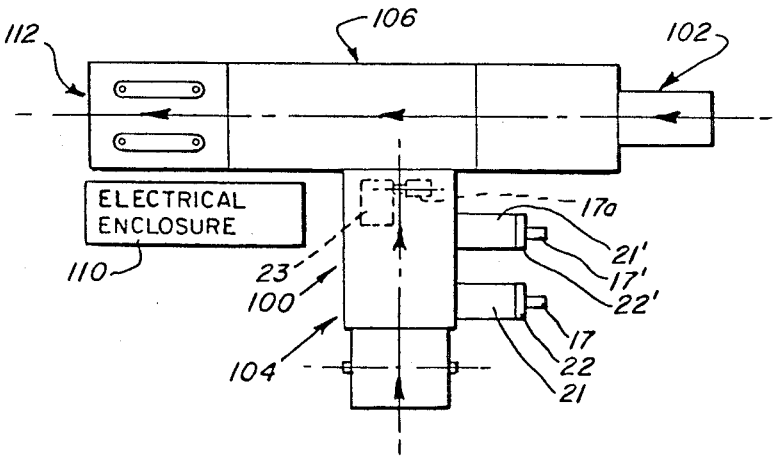
FIG. 6 is a plan view showing the location of various components of the web positioning and wrapper sheet transfer system of the invention.

FIGS. 6 and 7 show various components of a web positioning and wrapper sheet transferring system of the wrapping apparatus. Such system includes optical incremental encoders 17, 17' and **17*a*, rate multiplier units with encoder interfaces 18, 18' and 18*a*, system 55 logic boards 19 and 19', servo controllers 20 and 20' each consisting of a panel mounting unit with an 8 KW power supply and an internal shunt regulator and a servo controller consisting of two plug in assemblies, servo motors 21 and 21' with type B winding tachometers 22 and 22', respectively, and mounting adapter 7 couplings for mounting encoders 17 and 17', respectively, the programmable controller 1, a conjugate cam 23 and thumbwheel switches 24 and 24'**.

The purpose of the web positioning and wrapper sheet transfer system is to cut webs of paper to specific lengths, and then to transfer the lengths to a specific location. The two independent DC servo motors 21 and 21' control these functions. One motor 21 is coupled to nip rollers 26 shown in FIGS. 19, 20 and 21 that feed the web to a rotary shear 28 that cuts the web. The length of web that is fed by the feed nip rollers 26 determines the cut-off length of the resulting wrapper sheet. The velocity at which the feed nip rollers 26 travel is determined by a velocity curve that is generated by the conjugate cam unit 23. The second motor 21' is coupled to vacuum transfer belts 30 also shown in FIGS. 19, 20 and 21 that transfer the cut wrapper sheet to a specific location. The transfer belts 30 follow the same velocity curve that is generated for the feed nip rollers 26. However, the actual index distance of the transfer belts 30 is completely independent from that of the feed nip rollers 26.

The input shaft 32 of the conjugate cam 23 is rotated at a constant velocity. The output shaft 34 generates a velocity curve. The velocity is similar to a modified sine curve. The optical incremental encoder **17*a* is mechanically coupled to the output of the cam unit 23. The encoder 17*a* generates a pulse train representative of the velocity curve generated by the cam unit 23. This pulse train is input to two rate multiplier units 18 and 18' via conditioner board 18*a*. The machine operator enters in the shear cut-off length desired on the thumbwheel switches 24 and 24'. Two switches 24 and 24' are provided to give the operator the ability to control both the transfer distance and cut-off length independently. The data from the thumbwheel switches 24 and 24' is then input into the programmable controller 1 and this data is then processed. After the data is processed, it is output to the rate multiplier units 18 and 18'. The rate multiplier units 18 and 18' receive the pulse train and output a pulse train command. However, the frequency of pulses to each individual system 55 control logic board 19 and 19' changes depending upon the multiplier factor that is generated from the programmable controller 1. The system 55 control logic boards 19 and 19' receive a position command signal from their respective rate multiplier units 18 and 18'. They also receive a direction signal from the pulse conditioner board 18*a* such that the drive 20 and 21' follow the master encoder 17*a* in both directions. The system 55 control logic boards 19 and 19' output a position error or current command signal to the pulse width modulated drives 20 and 20'. The system 55 control logic boards 19 and 19' are each a closed loop system that controls both velocity and position of the associated motor 21 or 21'. The position error signal that is input to the drives 20 and 20' controls the velocity and the position of both motors 21 and 21'. The drives 20 and 20' can produce torque at zero speed and each has zero dead band such that the shafts of the servo motors 21 and 21' follow the cam unit 23** as if they were mechanically coupled.

The web positioning and wrapper sheet transfer system can be operated to handle wrapping paper with preprinted registration marks. For the nip roller to rotate, a position error is generated by pulses sent from the rate multiplier unit 18 to the system 55 logic board 19. These pulses are stored in an up/down counter. While the rate multiplier unit is putting pulses to the up count, rotation of the motor 21 puts pulses to the down count, trying to achieve a "0" count in the counter. When running a preprinted wrapper, the nip roller system is programmed to feed a sheet about $\frac{1}{4}''$ longer than the length of the printed sheet. When the nip roller nears the end of its cycle, an electric eye senses the presence of the register mark on the wrapper. At this point, the electric eye stops the rate multiplier unit from sending any more pulses to the system 55 logic board 19. It also sends a 1 millisecond pulse to the system 55 logic board 19 to reset the counter to "0". The nip roller drive 21 then comes to a stop, sending pulses to the counter while decelerating, and reverses to get the counter back to "0", i.e., to where the electric eye originally sensed the register mark.

Commercially available items sold under the following company/product names can be used as the indicated components. The optical incremental encoders 17*a*, 17 and 17' and be B.E.I. #H25G-SB-1250A-B2C SM18-5 optical incremental encoders. The pulse conditioner board 18*a* and the rate multiplier units 18 and 18' can be C.S.R. RMU-T-4 rate multiplier units with encoder interfaces. The system 55 logic boards 19 and 19' can be C.S.R. #1583 system 55 logic boards. The PWM servo drives 20 and 20' can be NC700 servo controllers each consisting of an A2318 panel mounting unit with 8 KW power supply and an internal shunt regulator and A2273 NC730 servo controller consisting of two plug-in assemblies. The DC servo motors 21 and 21' can each be an Inland #TT-4501-1200-B DC servo motor with a type B winding, tachometer 22 and 22' and a mounting adaptor 7 coupling for mounting a BEI H25G encoder 17 and 17'. The conjugate cam unit 23 can be a P-250-P1.5 H20-270 MSC.33 Camco cam unit. The thumbwheel switches 24 and 24' and be C.S.R. thumbwheel switches.

Figure 19:
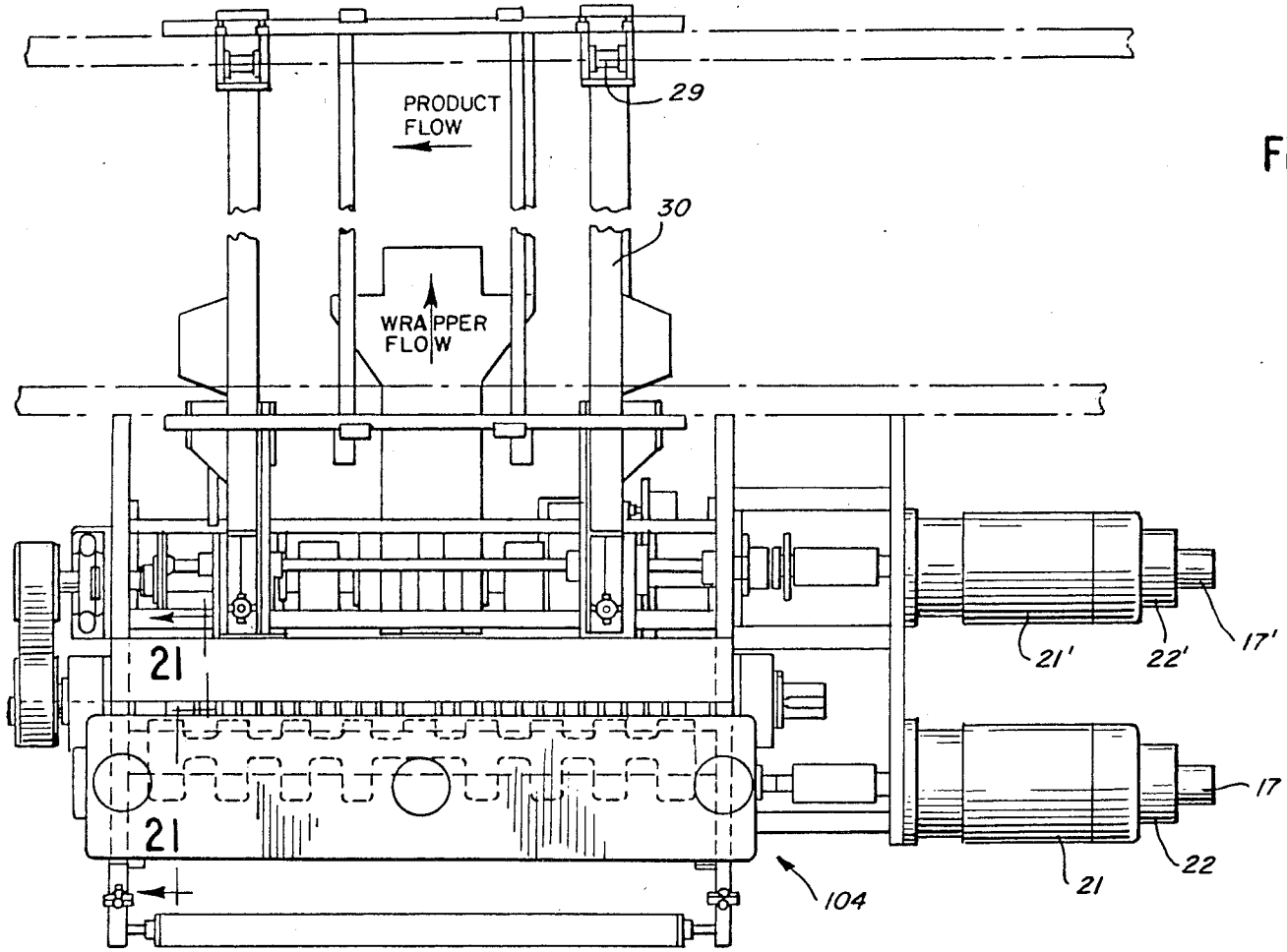
FIG. 19 is a top plan view of the shear assembly including the web positioning and wrapper sheet transfer system of the embodiment of FIG. 9 of the invention.
Figure 20:
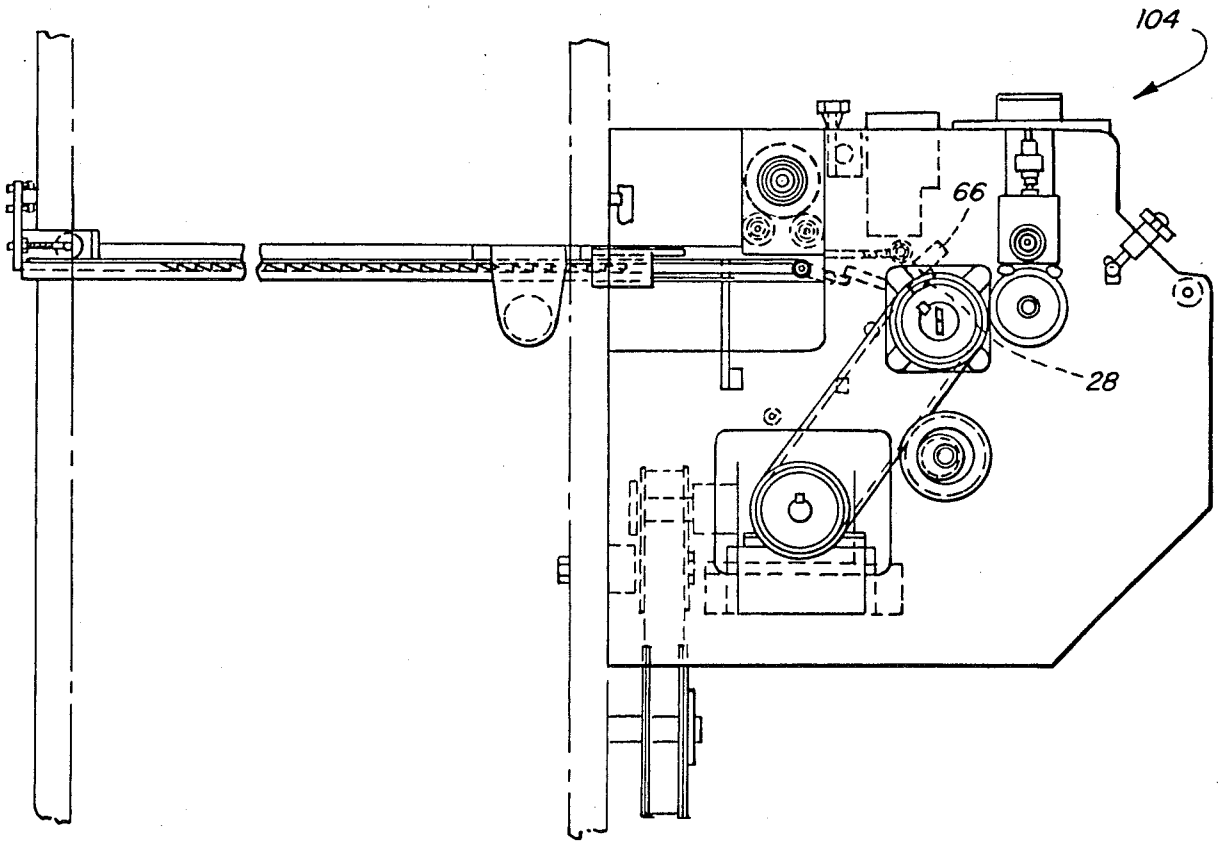
FIG. 20 is a side elevation view of the shear assembly of FIG. 19.
Figure 21:
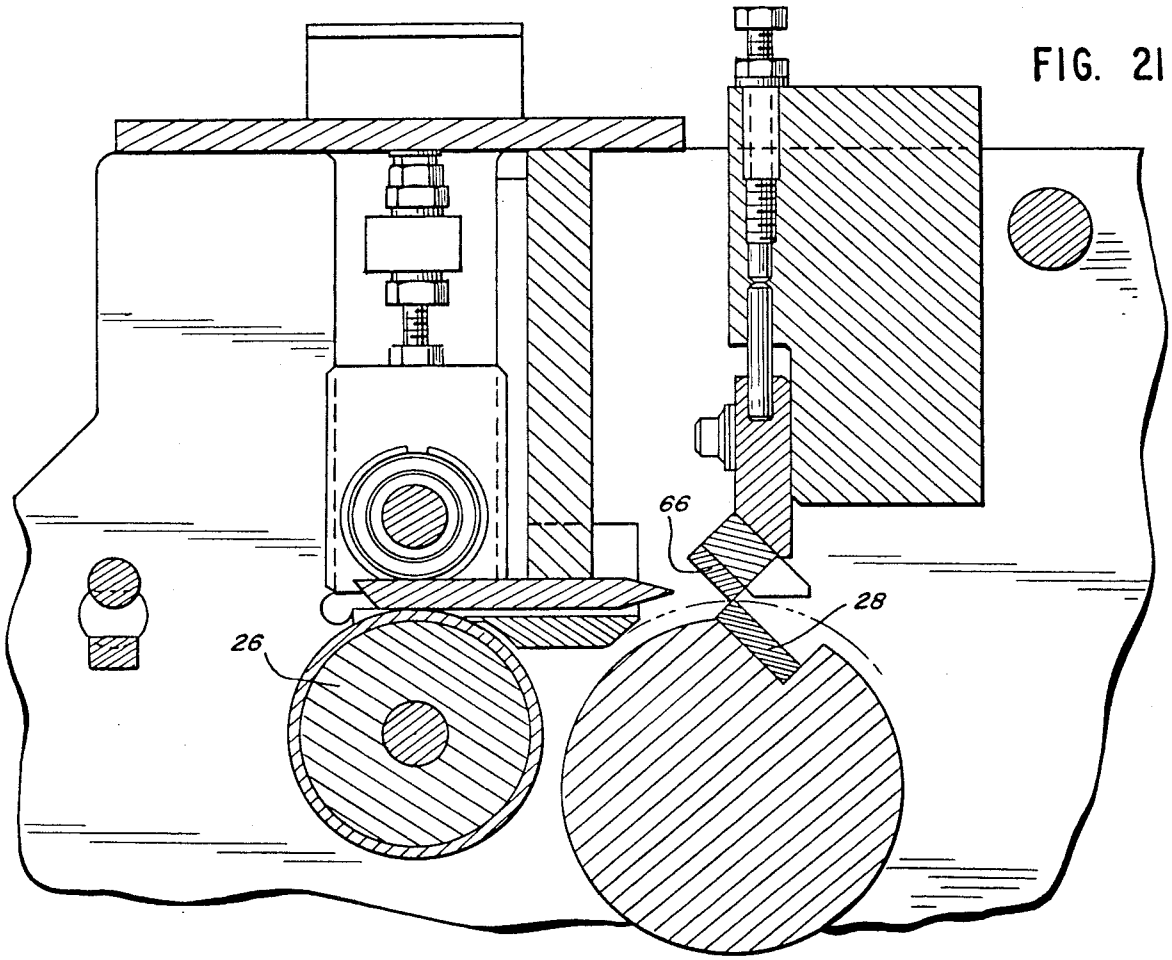
FIG. 21 is an enlarged vertical sectional view as seen in the direction of arrows from the line 21—21 of FIG. 19.

FIG. 8 shows the mechanical coupling of various components of the invention heretofore discussed. In particular, the mechanical coupling of the dynamic differential input/output phase adjustor drive 9, the rotating cam limit switch and pulse generating disc 3, the resolver 11 of the wrapping apparatus 100 and the stepping motor 8 of the resolver phase adjustment system is depicted. In addition, the mechanical coupling of the conjugate cam 23 and the optical incremental encoder 17*a* of the web positioning and wrapper sheet transfer system is depicted. Various other components of the web positioning and wrapper sheet transfer system are shown in FIGS. 19, 20 and 21.

FIG. 8 also depicts the mechanical coupling of components of the invention which will be discussed hereinafter. For example, FIG. 8 also shows the mechanical coupling of various components of the infeed section 102, which components are shown in FIGS. 13A, 13B, 14A, 14B, 15A, 15B, 16A and 16B. FIG. 8 also shows the mechanical coupling of various components of the wrapping section, which components are shown in FIGS. 9, 10, 11, 22, 23, and 24. FIG. 8, in addition, shows the mechanical coupling of various components of the discharge section 108, which components are shown in FIGS. 17A, 17B, 18A and 18B, to the main drive 4 for the wrapping apparatus 100 through the medium of a novel and unique conjugate cam 38 described more fully hereinafter.

FIG. 8A shows the mechanical coupling of the motor 21 to the feed nip rollers 26.

FIG. 8B shows the mechanical coupling of the motor 21' to the pulleys 29 over which the vacuum transfer belts 30 are trained.

Figure 9:
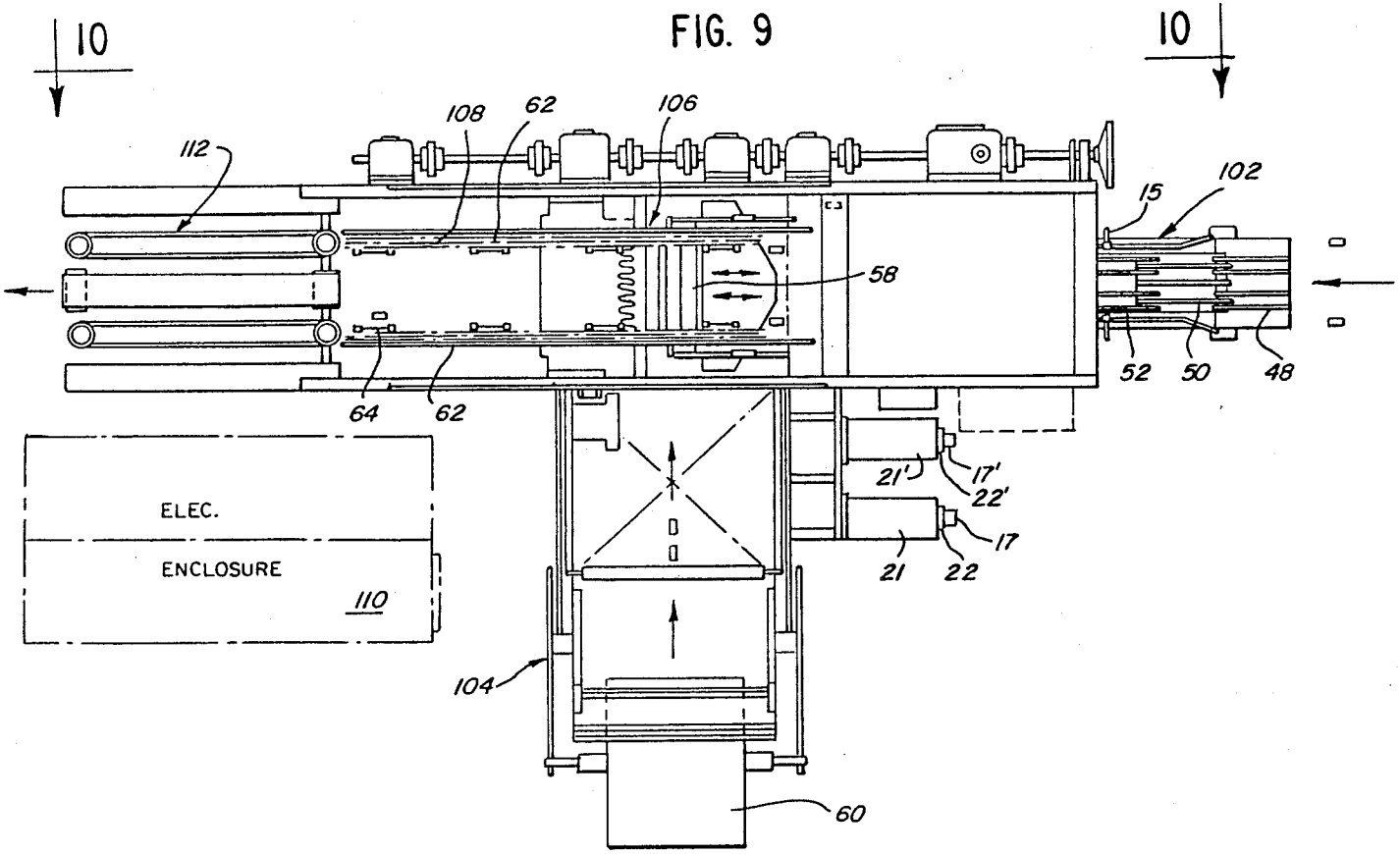
FIG. 9 is a top plan view of an embodiment of the invention.
Figure 10:
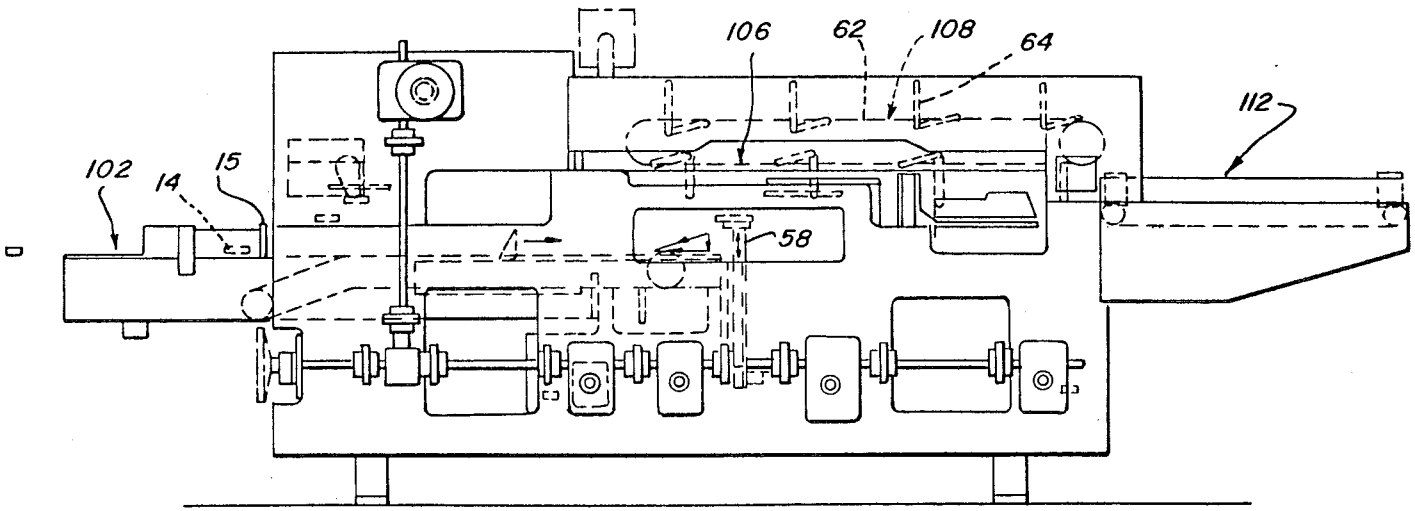
FIG. 10 is a side elevational view of the embodiment of FIG. 9 of the invention.
Figure 11:
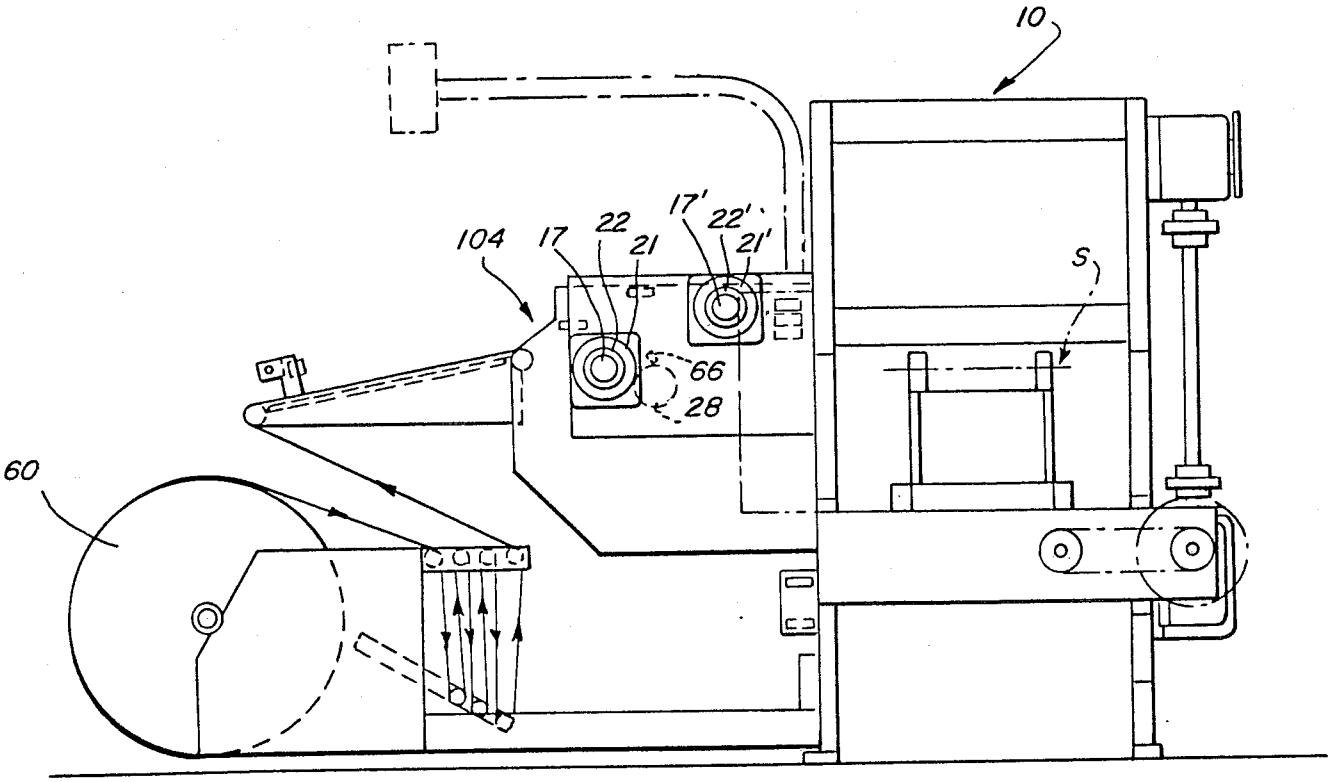
FIG. 11 is an end view of the embodiment of FIG. 9 of the invention.

FIGS. 9, 10 and 11 show the basic physical layout of the wrapping apparatus 100 of the invention. The reams to be wrapped are delivered to the infeed section 102. The infeed section 102 comprises a conveying mechanism denoted generally as 40 having variable first conveyor means 48 operated at the same speed as the speed of the discharge conveyors of the sheeter 200, second conveyor means 50 disposed upstream of the stop gates 15 of the holding station or ream stop gate system shown in FIG. 3, third conveyor means 52 which operate at a higher speed than conveyor means 50, such that conveyor means 50 initially slows down reams being received from the sheeter 200 and thereafter conveyor means 52 accelerates the reams so as to ensure desired spacing between the reams is effected, and fourth conveyor means 54 for delivering the reams released by the holding station or ream stop gate system to the phased flights or loading fingers 56 of the wrapping section 106 of the wrapping apparatus 100 and for subsequent transfer to elevator means. Simultaneously, i.e., while the ream is being delivered to the elevator means 58, the shearing assembly 104 is advancing a length of wrapping material off of a spool 60 of wrapping material, positioning the web above a rotary shear, such that the rotary shear cuts off a desired wrapper sheet length, and transferring the wrapper sheet to a position overlying the ream on the elevator 58. As the elevator means 58 raises each ream, mechanisms are provided for wrapping the wrapper sheet about the ream in a tubular shape. Thereafter, other known mechanisms are provided to glue the overlying sides of the wrapper sheet and subsequently to fold and glue the ends of the wrapper sheet. Once the ream has been elevated by the elevator means 58 and partially wrapped, it is engaged by the overhead discharge mechanism 108. The overhead discharge mechanism 108 comprises in known fashion a pair of belts or chains 62 which carry pusher arms 64 for engaging the partially wrapped reams on the elevator means 58 and transferring them to the left as seen in FIG. 9. Once folding and gluing of the ends of the wrapper sheet about the ream is completed, the ream is delivered by the overhead discharge section 108 to the compression assembly 112 which applies pressure to the ends of the wrapped reams to ensure sealing of same.

FIG. 10 shows from another prospective the various components of the wrapping apparatus 100. The operation of the overhead discharge mechanism 108 is more clearly understood from a review of FIG. 10. The chains or belts 62 which carry the pusher members or arms 64 are shown in phantom line. However, this FIG. nevertheless shows how the pusher arms 64 first come in behind reams raised by the elevator means 58 in a counterclockwise motion from the left as seen in FIG. 10 and thereafter urge the partially wrapped reams to the right as seen in FIG. 10 towards the compression assembly 112.

FIG. 11 is an end view of the apparatus of FIG. 9 showing increased details of the shear assembly 104. The web of wrapping material fed from the spool 60 by the feed nip rollers driven by the motor 21 passes between the rotary shear 28 and a stationary counter knife 66. Once a select length of web is cut off by the rotary shear acting against the stationary counter knife, the resultant wrapper sheet is advanced in a direction to the right as seen in FIG. 11 by the vacuum transfer belts 30 driven by motor 21' to a position overlying the elevator means shown in phantom line in FIG. 11 and denoted with the letter S.

Figure 12:
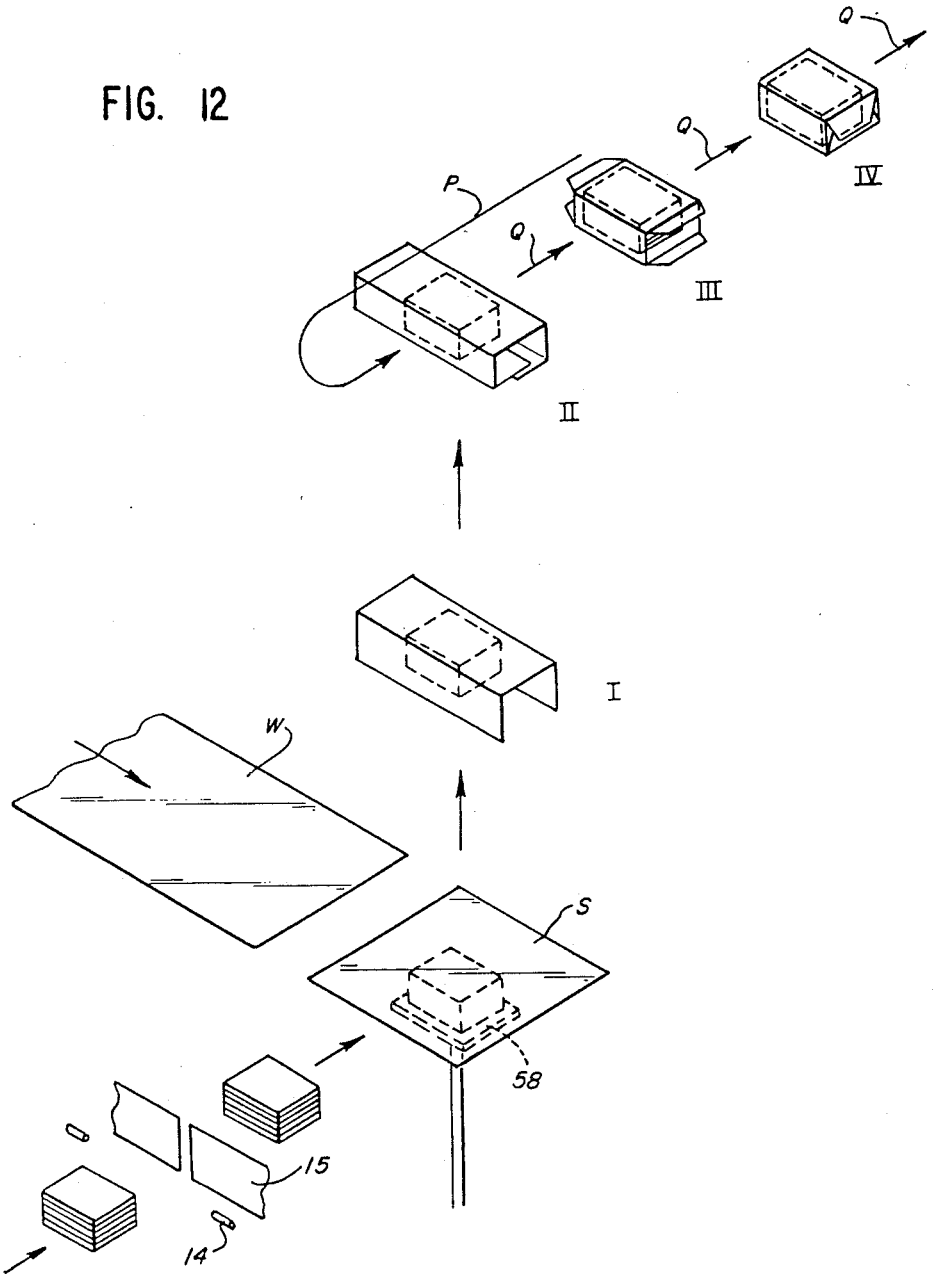
FIG. 12 is a schematic of the ream wrapping sequence of the embodiment of FIG. 9 of the invention.
Figure 13A:
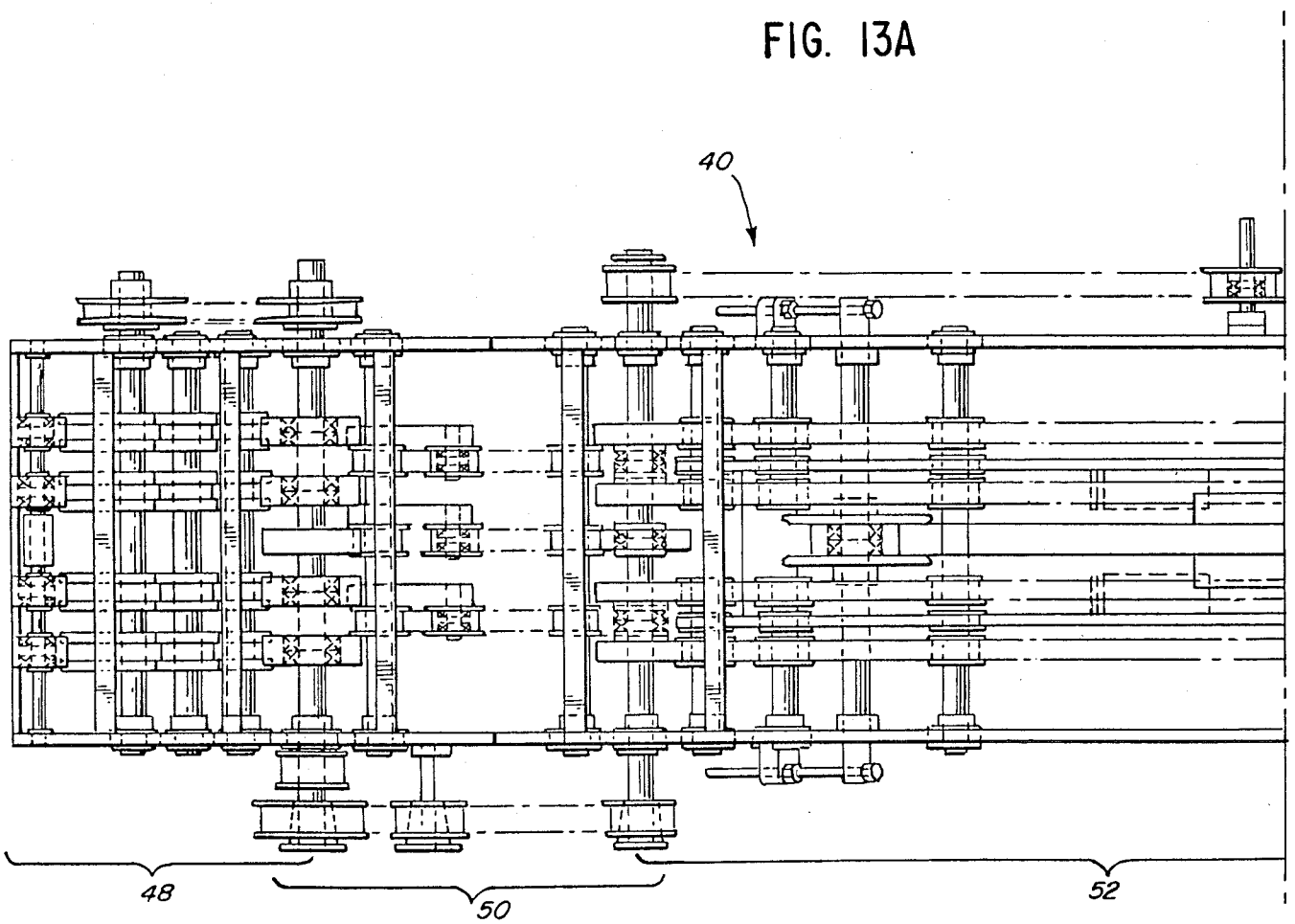
FIG. 13A is a top plan view of one half of the conveyor infeed section of the embodiment of FIG. 9 of the invention.
Figure 13B:
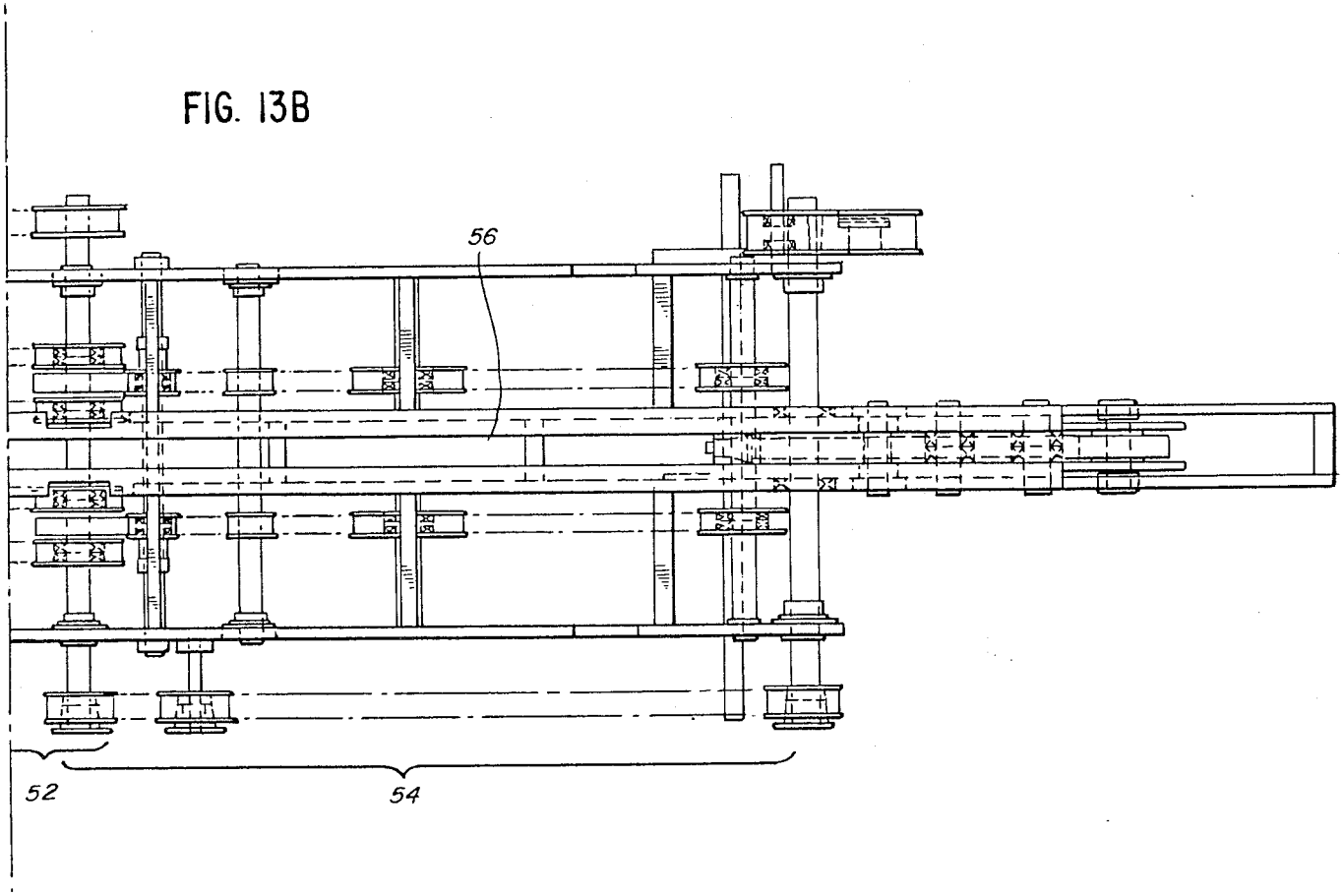
FIG. 13B is a top plan view of the other downstream half of the infeed conveyor section of the embodiment of FIG. 9 of the invention.
Figure 14A:
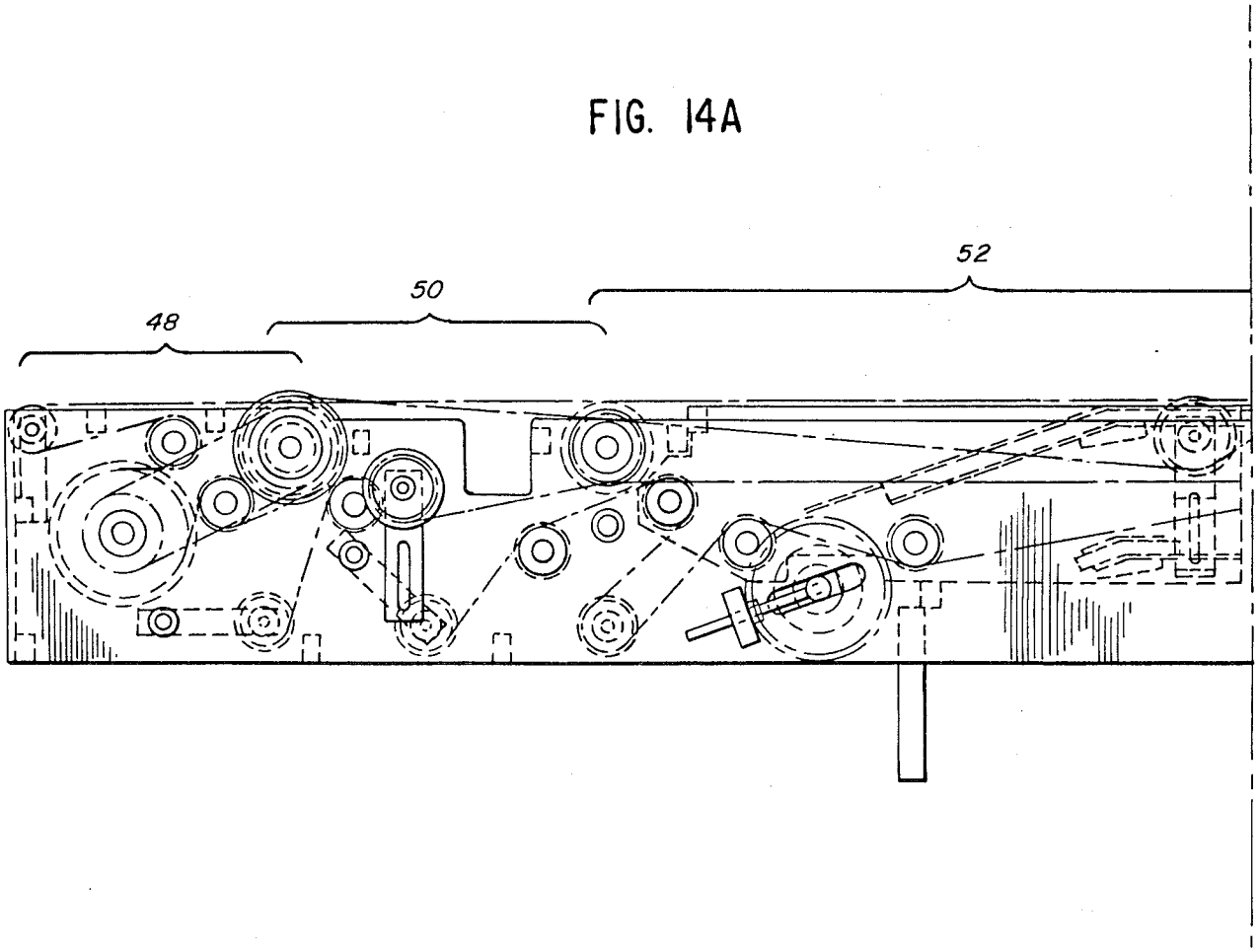
FIG. 14A is a side elevation view of the one half of the infeed conveyor section shown in FIG. 13A.
Figure 14B:
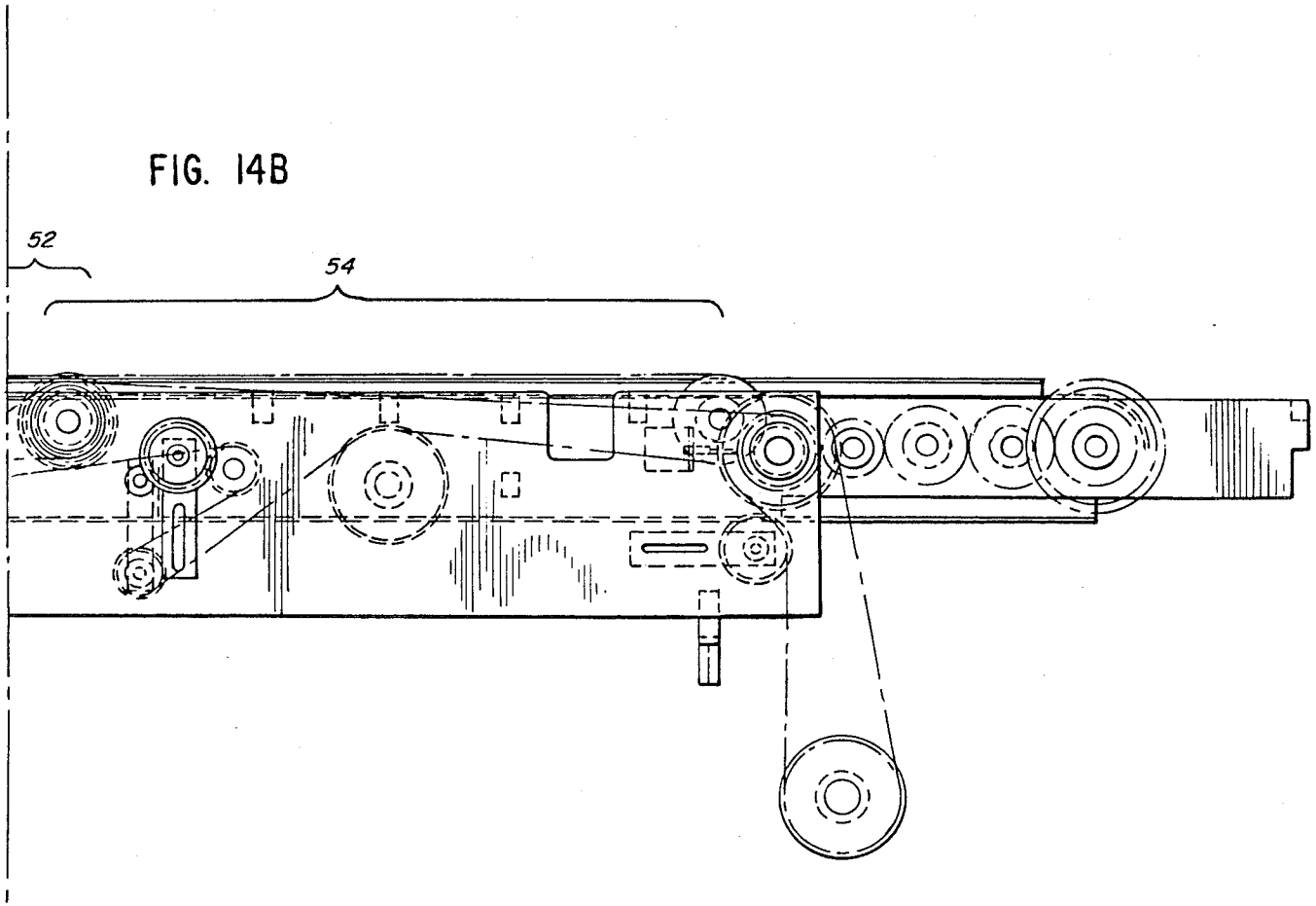
FIG. 14B is a side elvation view of the other downstream half of the infeed conveyor section shown in FIG. 13B.
Figure 15A:
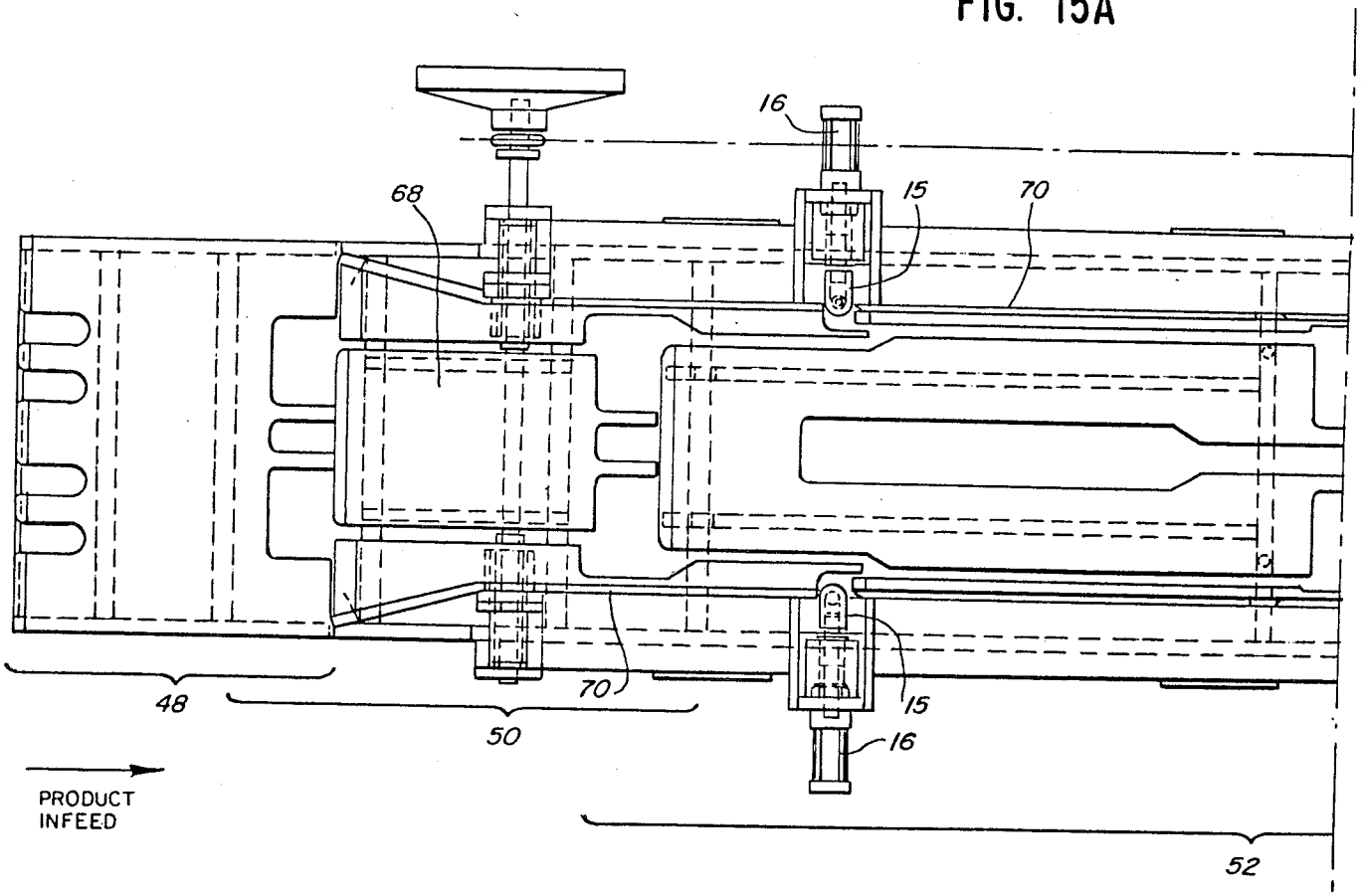
FIG. 15A is a top plan view of one half of the top surface over which the upper reaches of the infeed conveyor section of FIG. 13A travel and of the associated guide rails and the stop gates of the holding station or ream stop gate system of FIG. 3 of the invention.
Figure 15B:
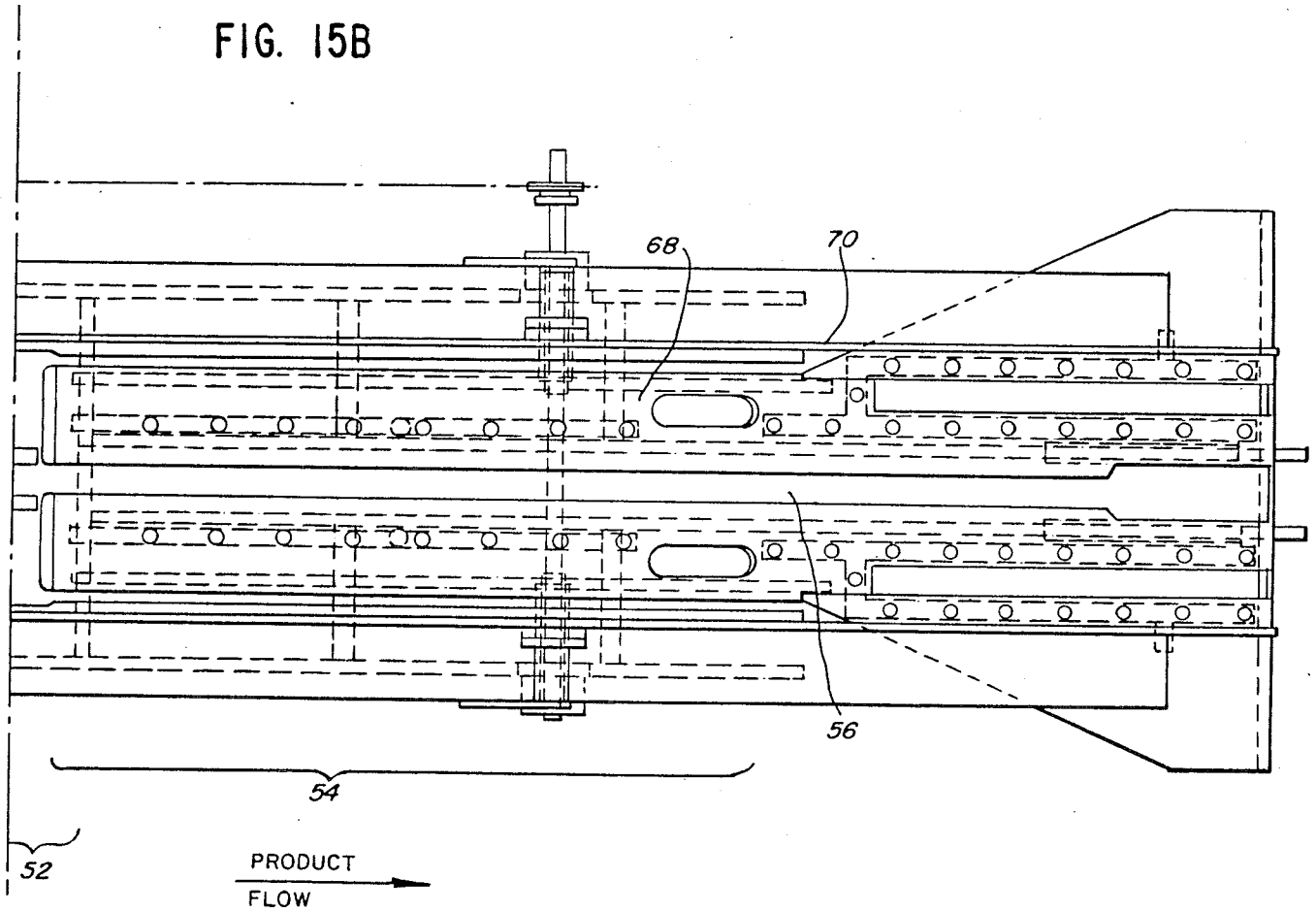
FIG. 15B is a top plan view of the other downstream half of the top surface over which the upper reaches of the infeed conveyor section of FIG. 13B travel and of the associated guide rails.
Figure 16A:
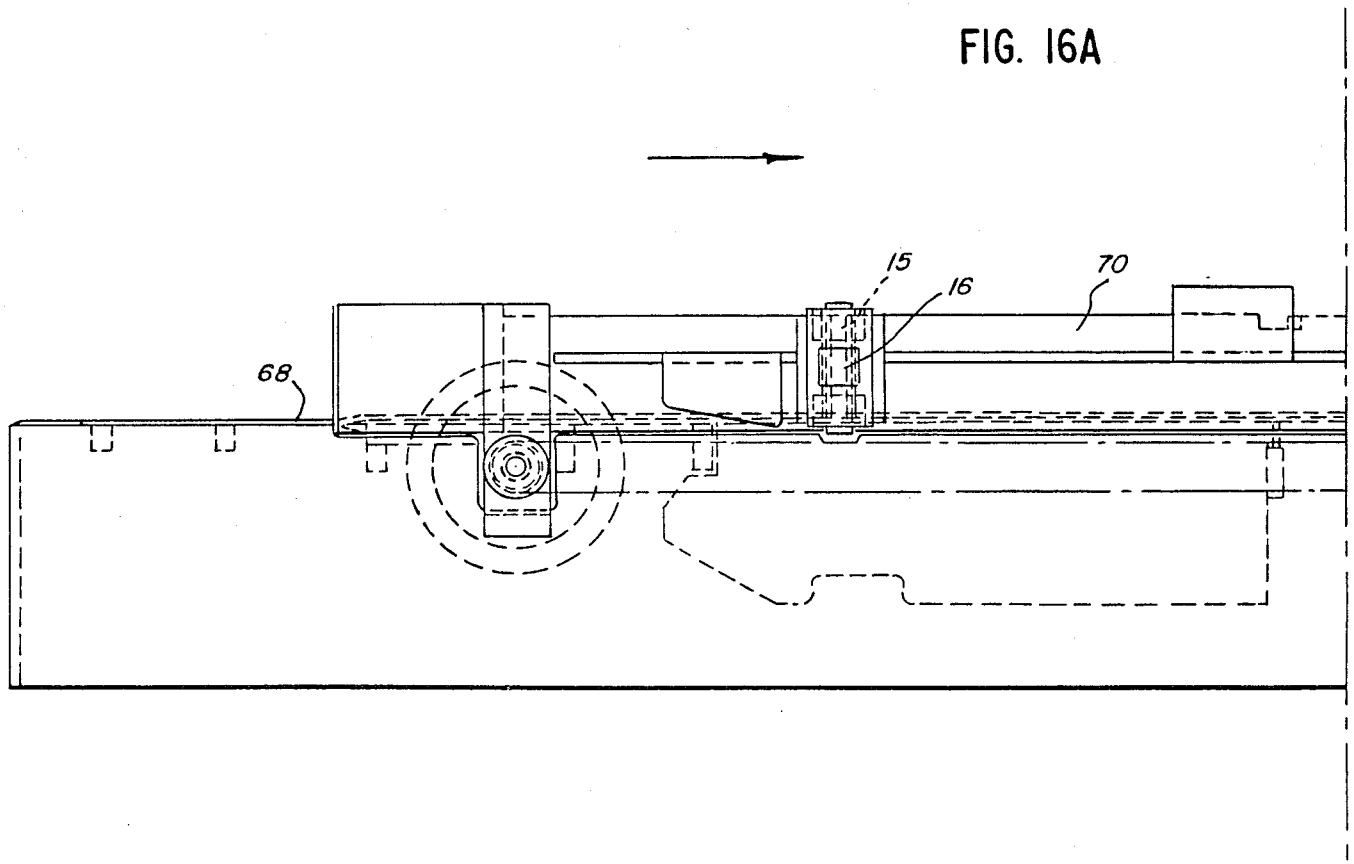
FIG. 16A is a side elevation view of the one half of the top surface, guide rails and stop gates of the holding station or ream stop gate system shown in FIG. 15A.
Figure 16B:
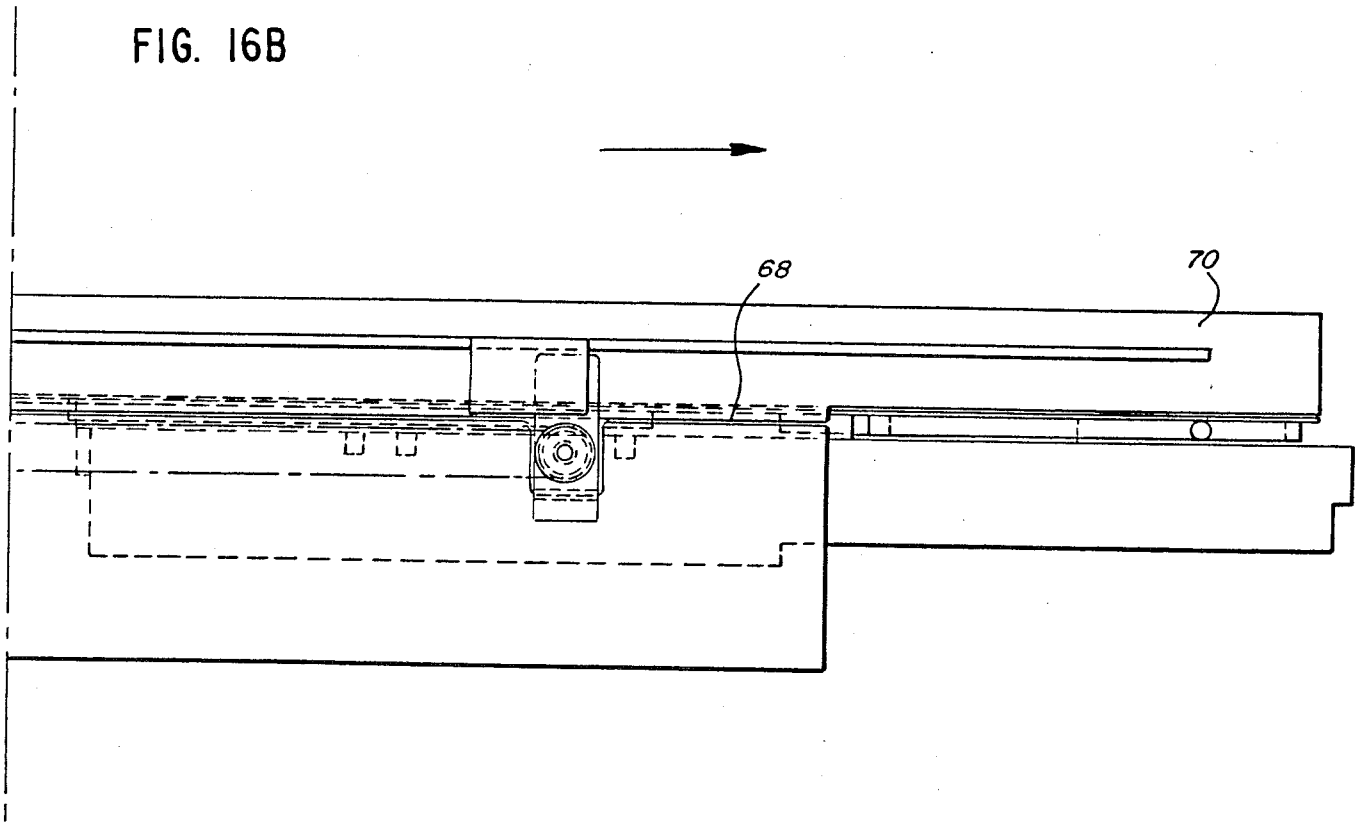
FIG. 16B is a side elevation view of the other downstream half of the top surface and guide rails shown in FIG. 15B.
Figure 17A:
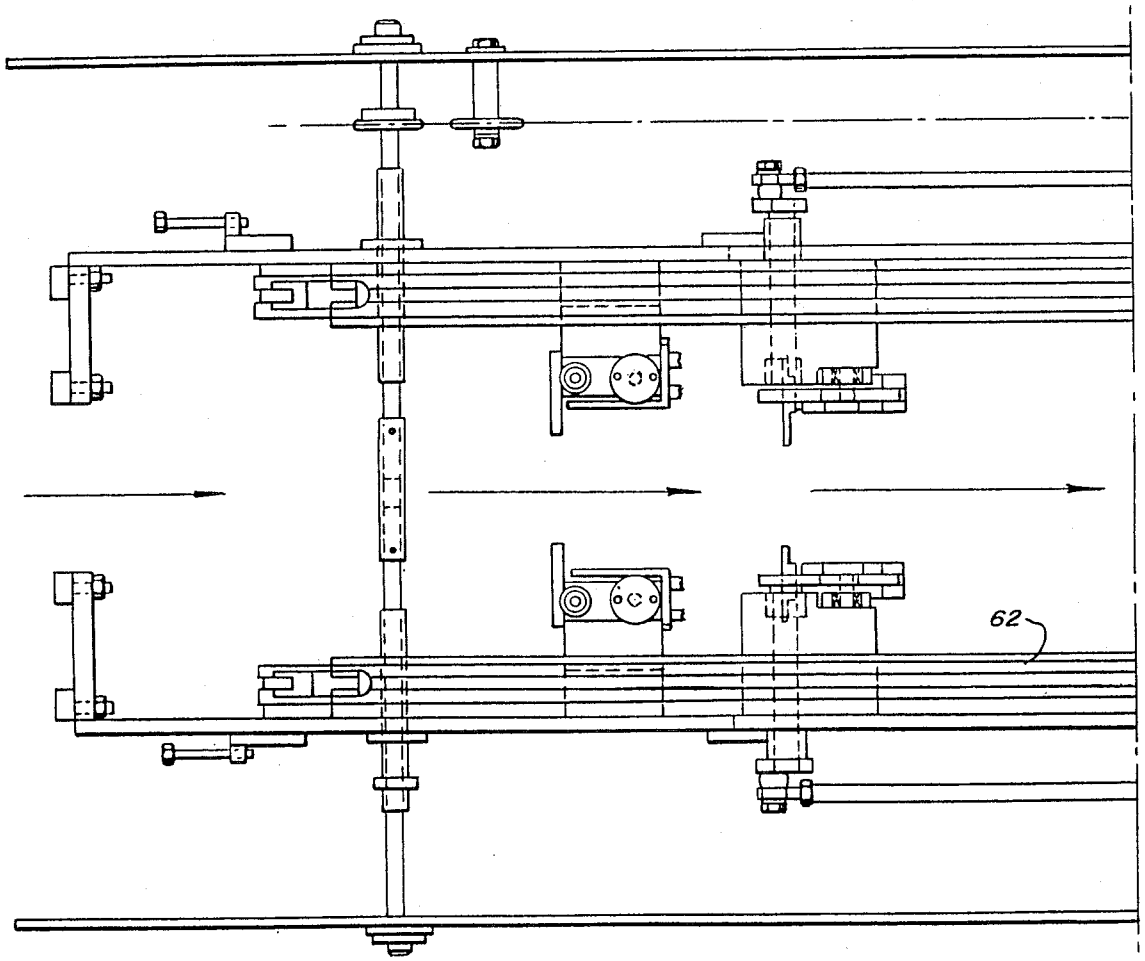
FIG. 17A is a top plan view of one half of the overhead discharge conveyor section of the embodiment of FIG. 9 of the invention.
Figure 17B:
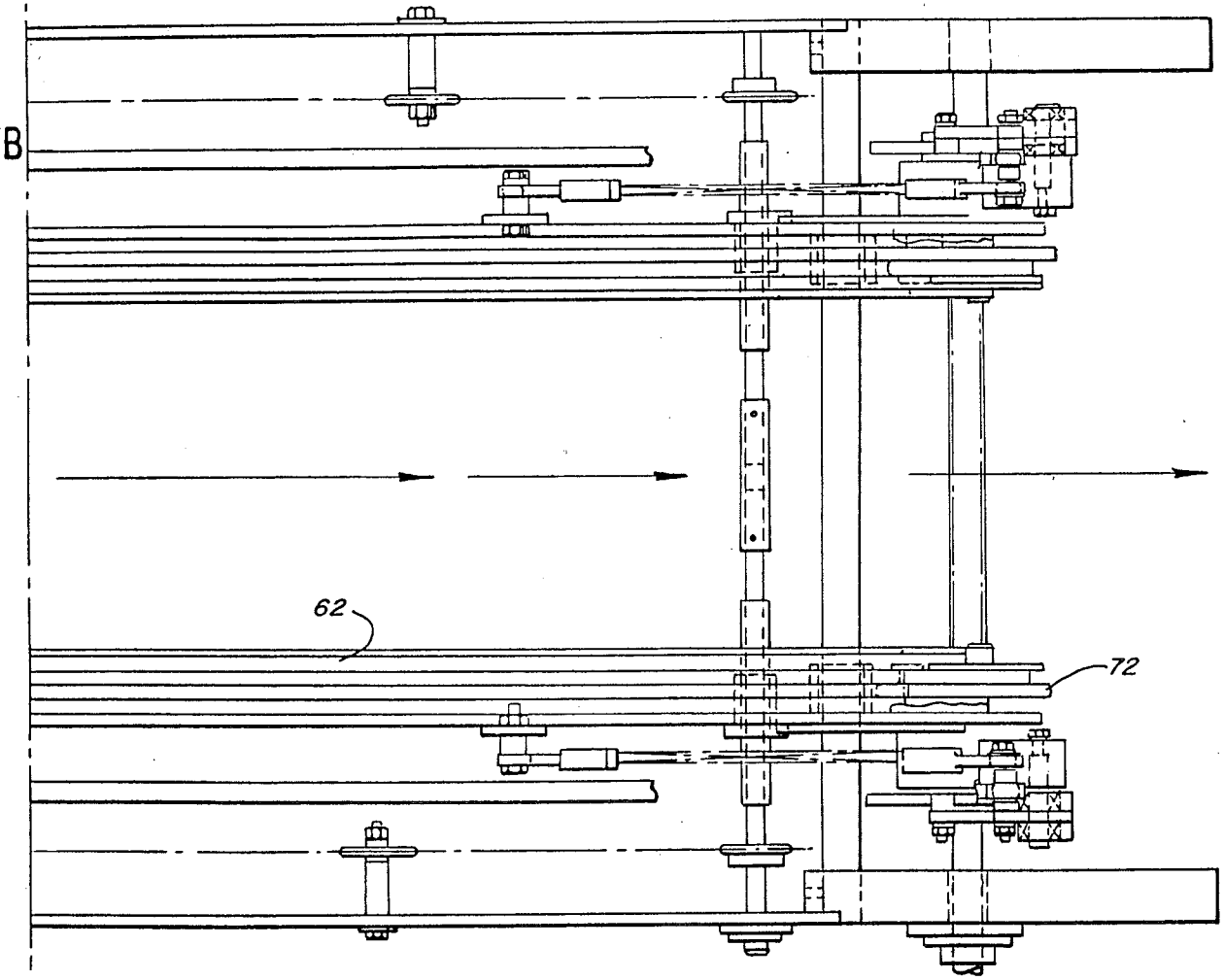
FIG. 17B is a top plan view of the other downstream half of the overhead discharge conveyor section of the embodiment of FIG. 9 of the invention.
Figure 18A:
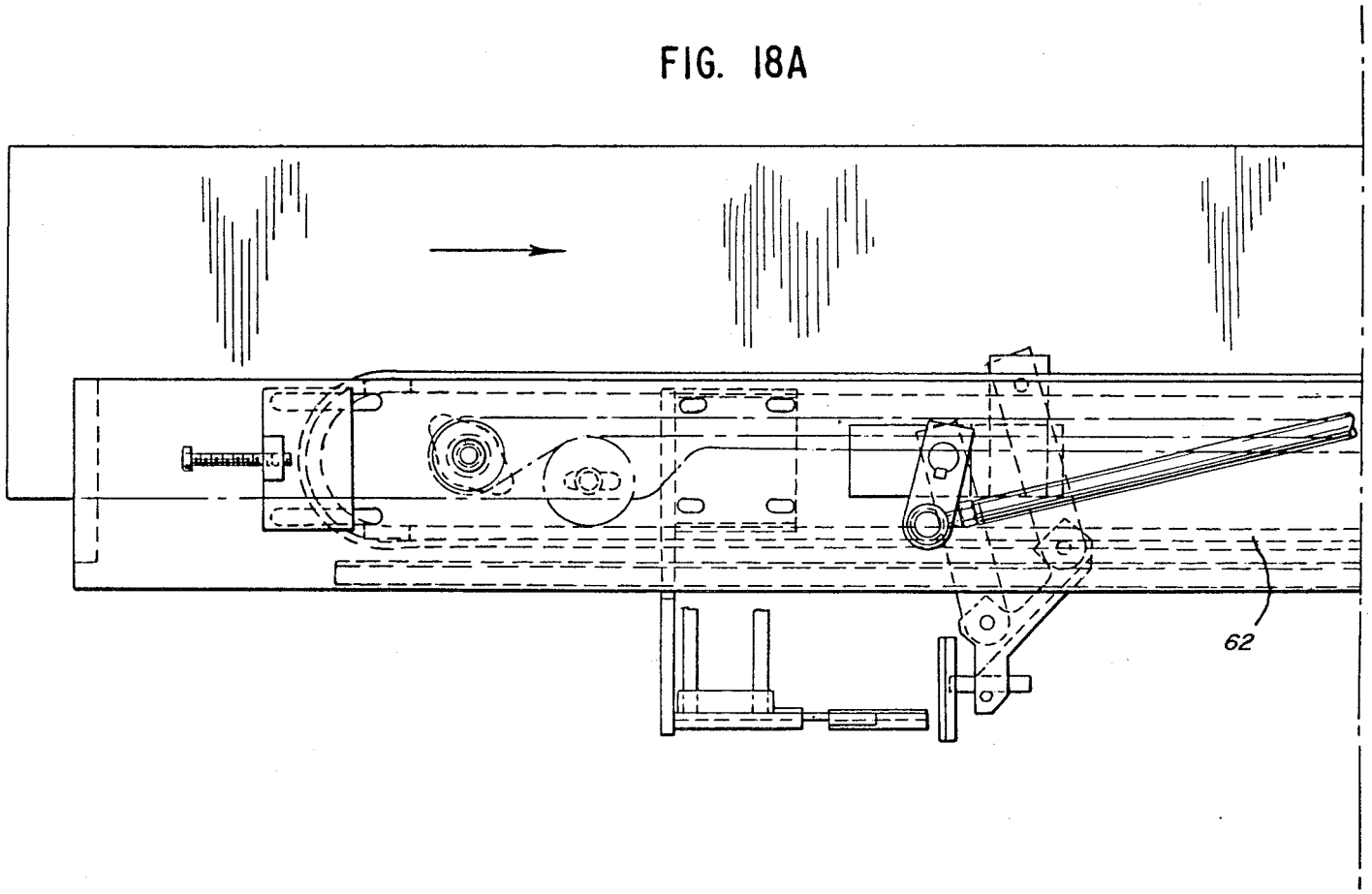
FIG. 18A is a side elevation view of the one half of the overhead discharge conveyor section shown in FIG. 17A.
Figure 18B:
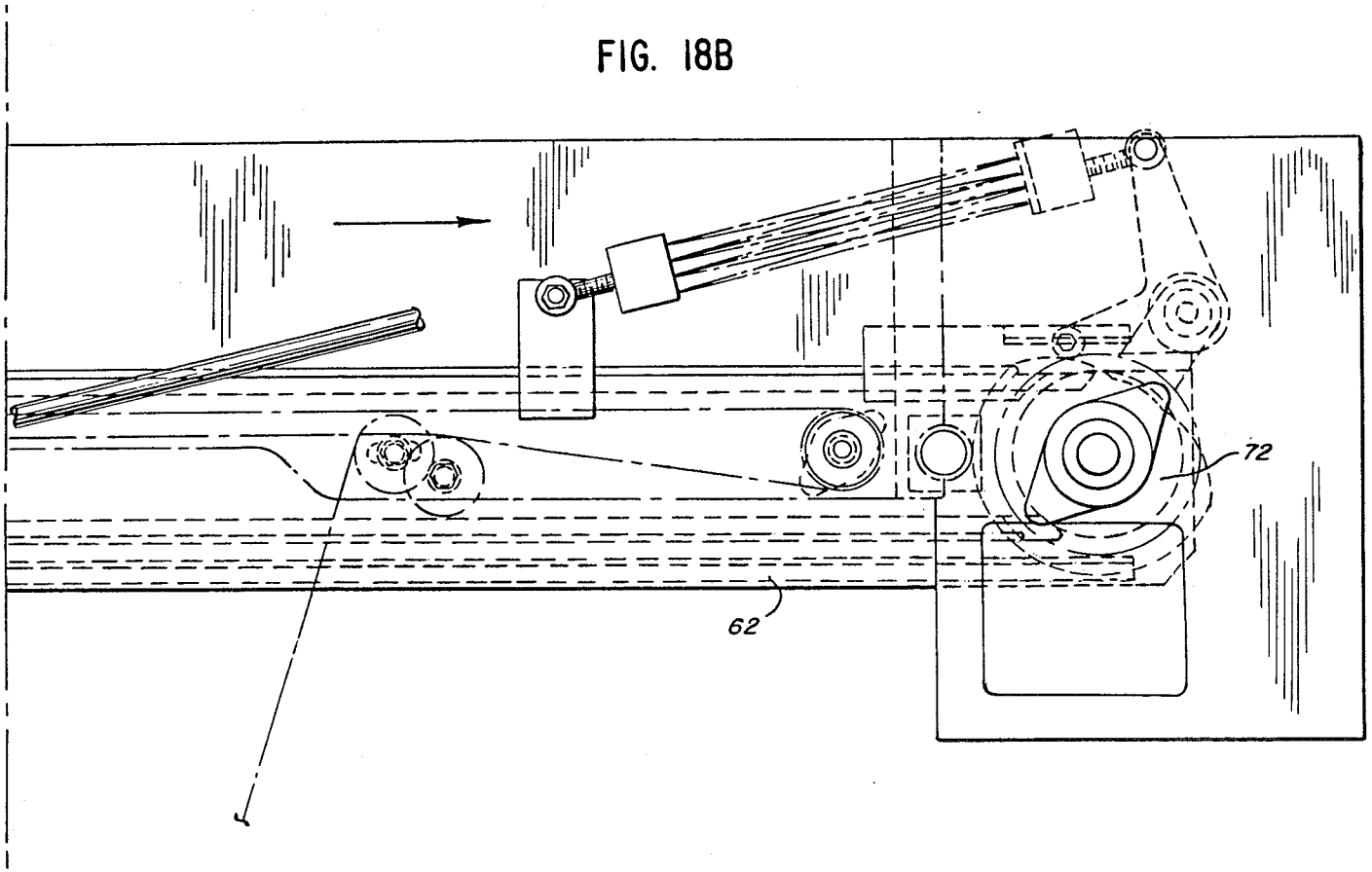
FIG. 18B is a side elevation view of the other downstream half of the overhead discharge conveyor section shown in FIG. 17B.

FIG. 12 shows generally the stages through which reams pass in the wrapping sequence. After passing through the holding station past the photoelectric eye 14 and gates 15, the ream is placed on the elevator means 58 and the wrapper sheet S is cut from the web W and is transferred to a position overlying the ream. Subsequently, when the elevator means 58 raises the ream, the wrapper sheet S is folded down around the sides of the ream and tucked underneath the ream so that the sides of the wrapper sheet are in overlapping relationship. The pusher arms 64 of the overhead discharge conveyor means thereupon come in behind the partially wrapped ream in a motion denoted by the arrow P, engaging the partially wrapped ream and shifting it in the direction of arrows Q while the wrapping means 106 completes folding and gluing of the ends of the wrapper sheet about the ream as shown.

The various components of the infeed section 102 are shown in FIGS. 13A, 13B, 14A, 14B, 15A, 15B, 16A and 16B. The infeed section 102 comprises an infeed conveying mechanism 40 and the photoelectric eye 14 and stop gates 15 of the holding station or ream stop gate system. The infeed conveying mechanism 40 comprises first, second, third and fourth conveyor means denoted 48, 50, 52 and 54, respectively, a multipart table surface 68 and side guide rails 70. The conveyor means 48, 50, 52 and 54 comprise belts trained over pulleys and tensioning members in a conventional manner well known in the art, the upper reaches of which are trained over the table surface 68.

FIGS. 17A, 17B, 18A and 18B show various components of the overhead discharge conveyor means 36 of the discharge section 108. The overhead discharge conveyor means 36 comprises two sets of double chains 62, a series of pusher arms 64 (also referred to as paddles, flights, fingers, tines or entraining elements) carried by each set of double chains and pulleys 72 around which the double chains are trained in the same manner as was accomplished in the assignee's prior Model 35 and Model 36 ream wrappers.

FIGS. 19, 20 and 21 show various components of the web positioning and wrapper sheet transfer system positioned relative to the other components of the apparatus. The wrapper and cut sheets are fed in an upwardly direction as seen in FIG. 19 and products to be wrapped are fed from right to left as seen in FIG. 19. The rotary cutter 28 is continuously cycled with the apparatus irrespective of whether a length of wrapper has been advanced. The wrapper is fed from right to left as seen in FIG. 20 and from left to right as seen in the reverse view of FIG. 21.

Figure 22:
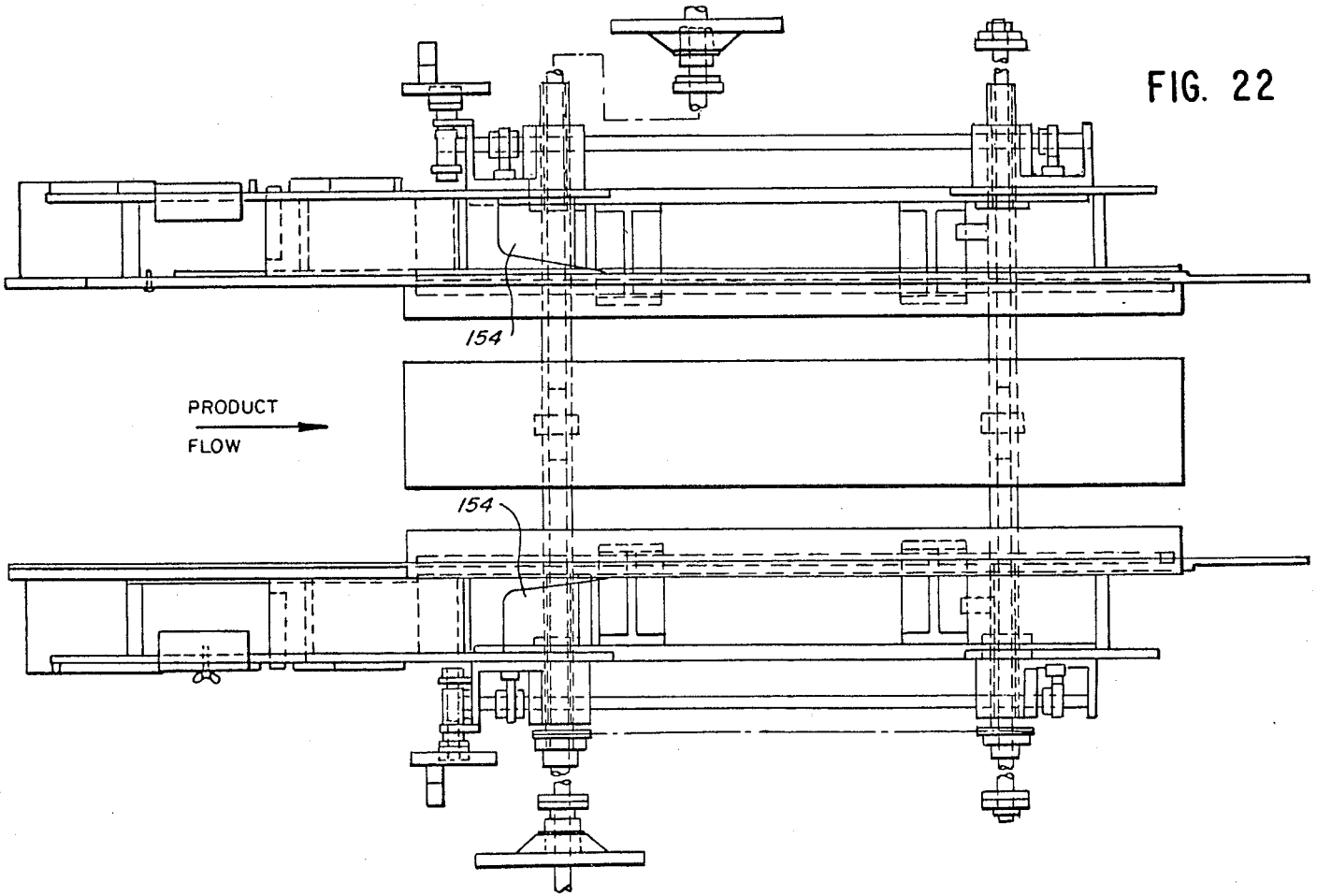
FIG. 22 is a top plan view of the wrapper sheet folding assembly of the embodiment of FIG. 9 of the invention.
Figure 23:
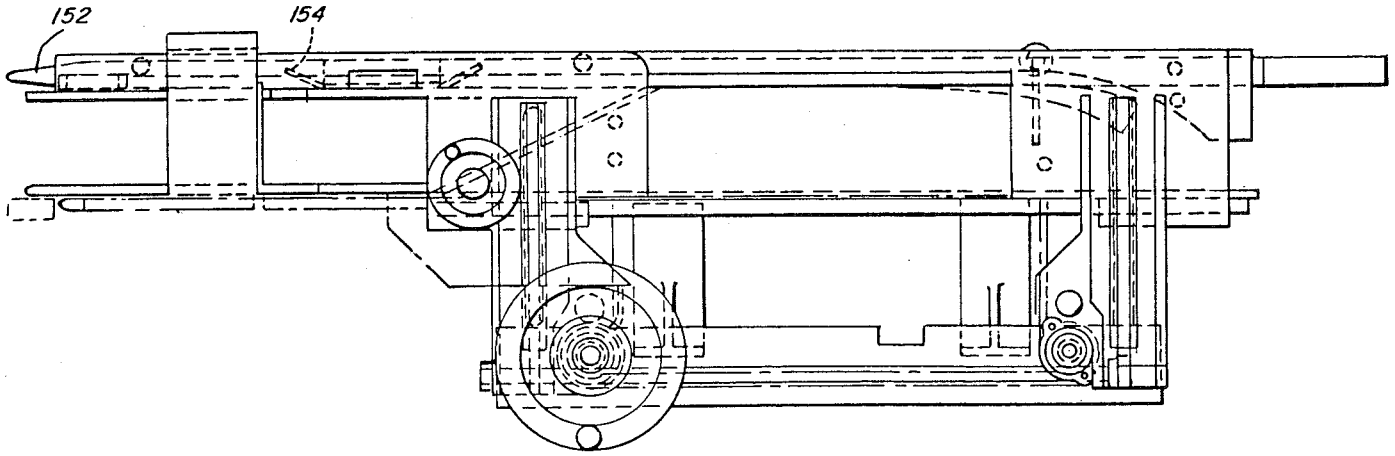
FIG. 23 is a side elevation view of the folding assembly of FIG. 22.
Figure 24:
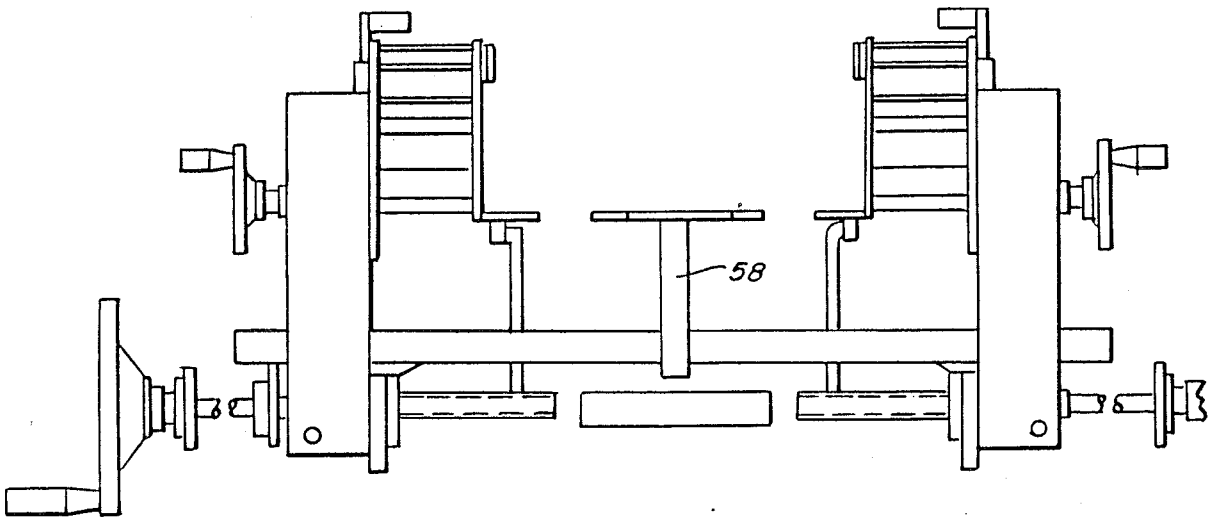
FIG. 24 is an end elevation view of the folding assembly of FIG. 22 looking in an upstream direction.

FIGS. 22, 23 and 24 show various components of the top folding portion of the wrapping section. This components of this section which accomplish the folding are the same as the components previously employed in the assignee's Model 35 and 36 ream wrappers. Prior art system showing such wrapping sections are disclosed in U.S. Pat. No. 3,861,120 to Gordon entitled Wrapping Apparatus and U.S. Pat. No. 3,213,591 to Feurstein et al. entitled Packaging and Wrapping Machine. As the product is raised on elevator 58, the cut wrapper sheet is draped around the product by downwardly extending plates (not shown) such that the product/wrapper sheet configuration is as shown at stage I in FIG. 12. As the product is elevated, front and rear underfolding plates (not shown) move underneath the product, enveloping the product in the wrapper sheet such that the product/wrapper sheet configuration is as shown at stage II in FIG. 12. Thereafter the product is engaged by the overhead discharge conveyor system and it begins to move from left to right as seen in FIGS. 22 and 23. The ends of the wrapping sheet are tucked in about the product by front stationary tuckers 152 and rear movable tuckers (not shown). The tucked in ends are thereafter creased by the action of plates 154 and then the top and bottom end flaps are folded against the ends of the product as the product continues to travel under the urging of the overhead conveying system.

Figure 25:
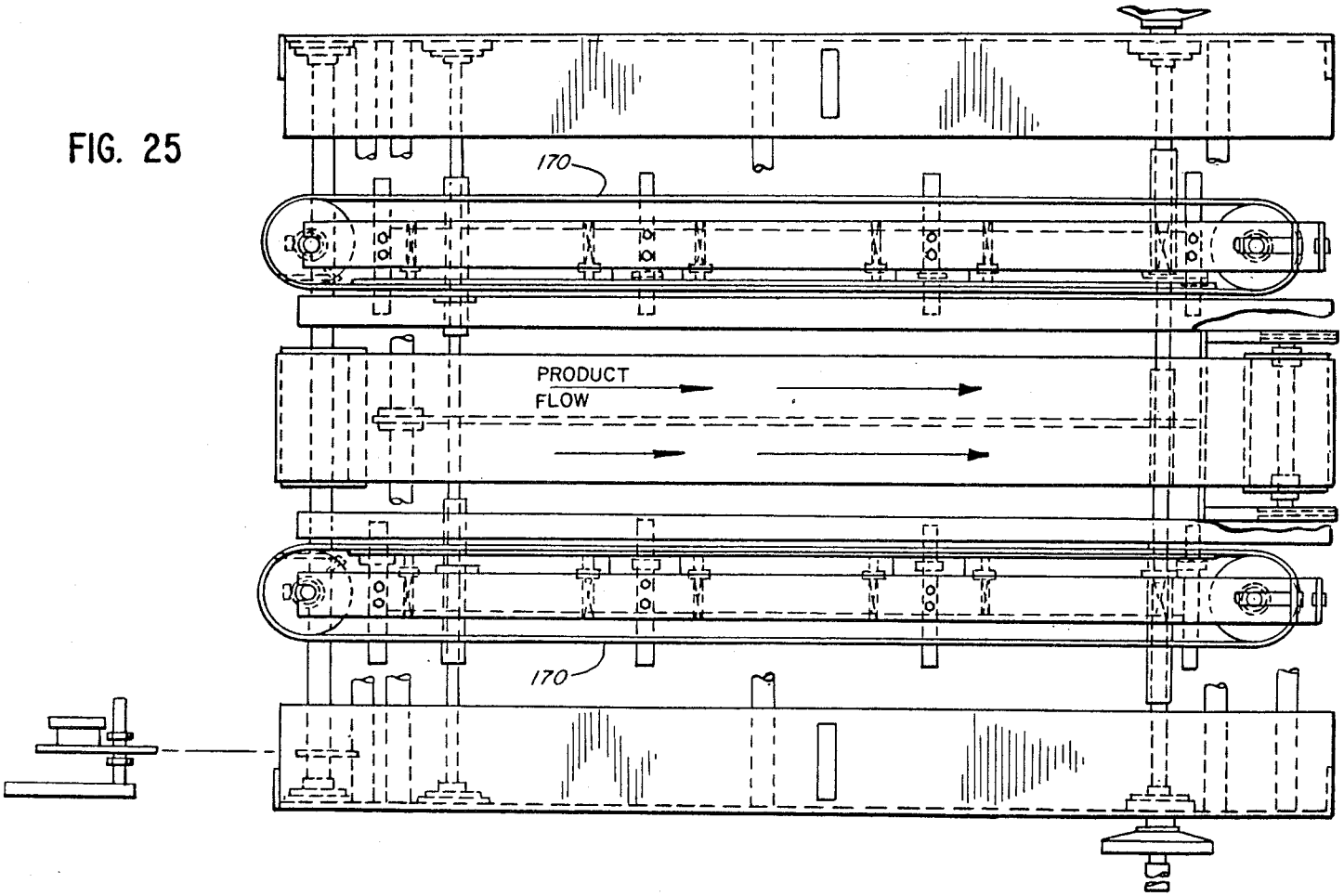
FIG. 25 is a top plan view of the compression assembly of the embodiment of FIG. 9 of the invention.
Figure 26:
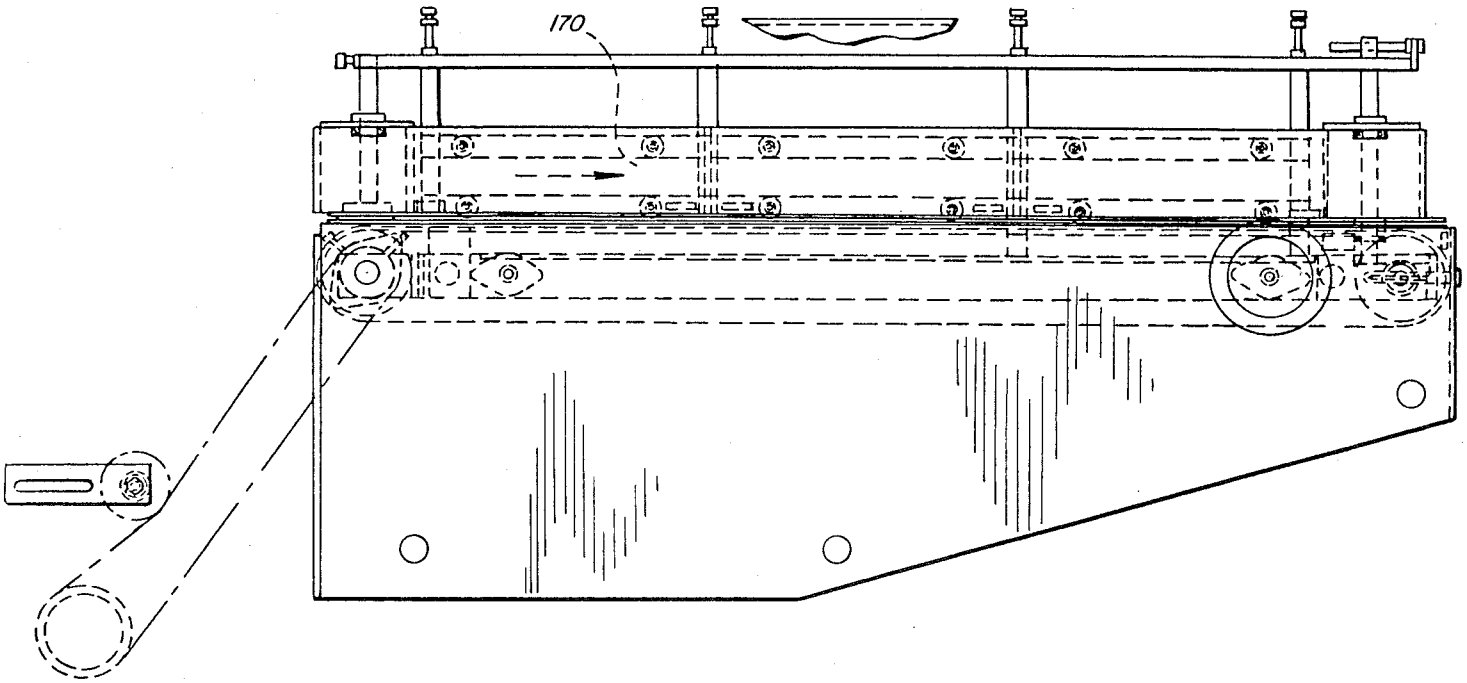
FIG. 26 is a side elevation view of the compression assembly of FIG. 25.

FIGS. 25 and 26 show various components of the compression assembly. The compression assembly consists of a belting arrangement whereby the wrapped product is advanced by conveyor belts 170 which engage and compress the folded sides of the wrapped product to ensure proper setting of the glue.

The apparatus and methods of the invention are susceptible of many modifications without departing from the spirit of the invention. Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

Wherefore, we claim:

1. A production line, particularly for wrapping reams of paper sheets or analogous piles into sheets of wrapping material, comprising a source of piles; a variable-speed wrapping apparatus having means for confining successive piles in sheets of wrapping material, said confining means comprising means for applying sheets of wrapping material to the piles; conveyor means for delivering piles from said source to said confining means at regular and/or random intervals; and means for electronically synchronizing the timing of operation of said wrapping apparatus with the rate of delivery of piles by said conveyor means, said synchronizing means comprising phase adjust loop means for automatically placing the operation of the wrapping apparatus in phase with operation of the source, means for automatically adjusting the spacing between the piles on said conveyor means prior to delivery to said wrapping apparatus including means for changing the speed of the piles, and means for controlling the delivery of piles to said applying means so as to effect such delivery in phase with the operation of said applying means.

2. The production line of claim 1, wherein said synchronizing means further comprises first signal generating means which is mechanically coupled to said source and is arranged to generate a first position and velocity reference signal, second signal generating means which is mechanically coupled to said wrapping apparatus and is arranged to generate a second position and velocity reference signal, means for comparing the first and second signals and for generating a third signal which is proportional to he position error of the source and the wrapping apparatus, and means for adjusting the timing of operation of the wrapping apparatus in response to said third signal and the velocity portion of said first signal.

3. The production line of claim 2, wherein said first signal generating means comprises a master resolver and a master tachometer generator both mounted on said source and respectively arranged to provide the position and velocity portions of said first reference signal.

4. The production line of claim 3, wherein said second signal generating means comprises a slave resolver mounted on said wrapping apparatus and arranged to provide said second reference signal.

5. The production line of claim 4, wherein said signal comparing means comprises a transducer interface board for summing the position signals received from said master and slave resolvers and for transmitting an analog third signal which is proportional to the position error of the master and slave resolvers.

6. The production line of claim 5, wherein said means for adjusting the timing of operation of said wrapping apparatus in response to said third signal comprises a pulse width modulated drive and a motor, said third signal in conjuction with the velocity portion of said first signal providing the reference command for the pulse width modulated drive which, in turn, controls the velocity of said motor.

7. The production line of claim 1, wherein said phase adjust loop means comprises means for detecting the presence of piles in the region of the infeed position of said wrapping apparatus, means for generating pulses based on the operation of said wrapping apparatus in response to to activation by said detecting means, signal generating means for monitoring said pulse generating means, and means for adjusting the timing of operation of said wrapping apparatus in response to signals from said monitoring means.

8. The production line of claim 7, wherein said adjusting means comprises a slave resolver for controlling the position of the wrapping apparatus and a stepping motor for advancing or retarding said slave resolver.

9. The production line of claim 1, wherein said means for adjusting the spacing between the piles on said conveyor means comprises means for slowing down the piles which are about to be wrapped and means for thereafter accelerating the piles.

10. The production line of claim 9, further comprising means for monitoring the spacing between successive piles and means for holding the piles against further movement in the absence of desired spacing.

11. The production line of claim 10, wherein said monitoring means comprises a photoelectric detector and said holding means comprises fluid-operated openable and closable gates and valves which control the operation of said gates.

12. The production line of claim 11, further comprising means for delaying the closing of said gates to thus prevent the gates from interfering with the delivery of piles.

13. The production line of claim 12, wherein said phase adjust loop means comprises means defining a timing window corresponding to those portions of the operation of said wrapping apparatus during which the wrapping apparatus is capable of receiving piles for wrapping and means for delaying reopening of said gates until said timing window is registered.

14. A method of wrapping block-shaped commodities, particularly piles of paper sheets which are received by a wrapping apparatus from a sheeter or an analogous source, into sheets of paper or like wrapping material, comprising the steps of electronically coupling the wrapping apparatus to the source; and continuously and automatically synchronizing the timing of operation of the wrapping apparatus with the rate of delivery of commodities from the source, including automatically adjusting the phase relationship of the wrapping apparatus relative the source, automatically adjusting the spacing between commodities which are being delivered from the source prior to introduction of such commodities into the wrapping apparatus and controlling the delivery of the commodities to said wrapping apparatus so as to effect such delivery in phase with the operation of said wrapping apparatus.

* * * * *